United States Patent [19]

Becka Michael M.

[11] 4,389,745

[45] Jun. 28, 1983

[54] MOLDING AN INSOLE AND ATTACHING THE MOLDED INSOLE TO A LAST BOTTOM

[75] Inventor: Becka Michael M., Nashua, N.H.

[73] Assignee: International Shoe Machine Corporation, Nashua, N.H.

[21] Appl. No.: 262,665

[22] Filed: May 11, 1981

[51] Int. Cl.[3] ..... A43D 9/00

[52] U.S. Cl. ..... 12/142 T; 12/1W

[58] Field of Search ..... 12/142 R, 142 T, 1 W, 12/17 R, 33.6, 18.1, 21

[56] References Cited

U.S. PATENT DOCUMENTS

| | | | |
|---|---|---|---|
| 2,762,067 | 9/1956 | Gross | 12/21 |
| 3,439,367 | 4/1969 | Becka et al. | 12/142 T |
| 3,513,495 | 5/1970 | Becka et al. | 12/1 W |

*Primary Examiner*—Patrick D. Lawson

[57] ABSTRACT

An arrangement for molding a flat insole (412) and adhesively attaching the molded insole to the bottom of a last (414) comprising an upper mold (62) and a lower mold (14) having complementary molding surfaces that are initially spaced from each other so that the flat insole is transported between the molding surfaces and are then closed upon the insole to mold the flat insole to the shape of the molding surfaces. The upper mold is then raised while the molded insole is retained on the upper mold molding surface after which the insole is released from the upper mold molding surface and descends onto the bottom of the last. The molded insole is then pressed onto the last bottom by an applicator (378) and is attached to the last bottom by an adhesive patch (421) on the last bottom that was previously applied to the last bottom by the applicator.

45 Claims, 38 Drawing Figures

MOLDING AN INSOLE AND ATTACHING THE MOLDED INSOLE TO A LAST BOTTOM

BACKGROUND AND SUMMARY OF FIRST ASPECT OF THE INVENTION

It has long been conventional practice in the fabrication of shoes to temporarily attach a molded or shaped insole to the bottom of a last so that the molded insole may remain in place on the last bottom while shoe manufacturing operations, such as a lasting operation, are performed. U.S. Pat. Nos. 3,439,367 and 3,513,495 are illustrative of prior art machines that mold the insole and attach the molded insole to the last bottom by adhesive.

It is the object of the first aspect of the invention to provide a new arrangement for effecting the molding of the insole and the attachment of the insole to the last bottom that accomplishes this in a rapid, expeditious and effective manner. This is accomplished by transporting the flat insole between a lower mold and an upper mold having complementary molding surfaces while the molds are spaced from each other; then effecting relative closing movement of the molds upon the insole to enable the molding surfaces to mold the insole; then raising the upper mold while retaining the molded insole on the upper mold molding surface; then placing the last, while it is supported bottom-up, between the molds; then releasing the molded insole from the upper mold molding surface to permit the molded insole to descend onto the last bottom; and then attaching the molded insole to the last bottom.

BACKGROUND AND SUMMARY OF SECOND ASPECT OF THE INVENTION

It is customary, in insole molding machines, for the complementary molding surfaces to have ball portions that are at higher elevations than the remainder of the molding surfaces and to so locate the flat insole between the molding surfaces that the ball portion of the flat insole is in heightwise registration with the ball portions of the molding surfaces in order to provide for efficient molding of the flat insole pursuant to the closing of the molding surfaces upon the insole as illustrated in U.S. Pat. Nos. 2,762,067 (column 2, lines 18–20 and column 4, lines 27–35) and 3,513,495 (column 8, line 62–column 10, line 10).

In order to automatically and efficiently provide for the heightwise registry of the ball portions of the insole and of the molding surfaces, in accordance with this invention there is provided an insole support, on which the insole is supported, that is movable a prescribed distance to bring the insole between the molding surfaces and insole shifting means so cooperative with the insole that, regardless of the length of the insole, the insole is so shifted on the insole support that the movement of the insole through its prescribed distance brings the ball portion of the insole into substantial heightwise registry with the ball portions of the molding surfaces.

BACKGROUND AND SUMMARY OF THE THIRD ASPECT OF THE INVENTION

In the closing of the molds on the insole, the molds have to be initially spaced from each other to permit the insole to be transported therebetween. Heavy molding pressure must be applied by the closed molds on the insole in order to effectively mold the insole. In accordance with this invention, the closing of the molds is effected by raising the lower mold under relatively light pressure a relatively great distance to bring the lower mold in position to commence to mold the insole and to a position wherein the heavy molding pressure can be applied. This is followed by the application of heavy molding pressure to the lower mold with a relatively small rise of the lower mold so that the heavy molding pressure can be applied without substantially moving the molds heightwise relative to each other to thereby enable the insole to be effectively molded without subjecting the insole to under compression such as would damage the insole or the molds.

BACKGROUND AND SUMMARY OF THE FOURTH ASPECT OF THE INVENTION

It is known to adhesively attach the molded insole to the last bottom as illustrated by U.S. Pat. Nos. 3,439,367, 3,513,495, 3,052,904, 3,257,677 and 3,443,288. This aspect of the invention is concerned with an improved arrangement for adhesively attaching the molded insole to the last bottom.

In accordance with this aspect of the invention, prior to the insole being placed on the last bottom, an applicator of an adhesive applying mechanism is pressed against the last bottom. The applicator has located thereon a segment of adhesive, known of itself, that is so constituted as to be separated from the applicator and adhere to an object when the applicator is pressed against the object. The pressing of the applicator against the last bottom therefore causes the adhesive segment to adhere to the last bottom. Subsequently, after the insole has been placed on the last bottom, the applicator is caused to press the insole against the last bottom to thereby enable the insole to adhere to the last bottom by way of the adhesive segment.

BACKGROUND AND SUMMARY OF THE FIFTH ASPECT OF THE INVENTION

In the molding of the flat insole to the shape of the complementary molding surfaces, the molding surfaces are conventionally spaced from each other while the flat insole is transported between the molding surfaces, the molding surfaces are then closed on the insole to mold the insole, and the molding surfaces are then opened away from each other to permit the molded insole to be removed from between the molding surfaces. In order to facilitate this removal of the molded insole, this aspect of the invention provides a lifting mechanism that is operative to lift at least part of the molded insole upwardly of the lower mold molding surface when pressure is removed from the lower mold molding surface pursuant to the opening of the molding surfaces. This lifting mechanism is useful when the molded insole is to be retained on the upper mold molding surface in accordance with the first aspect of the invention or when the molded insole is simply to be removed from between the molding surfaces.

DESCRIPTION OF THE PREFERRED EMBODIMENT

Figure 1:
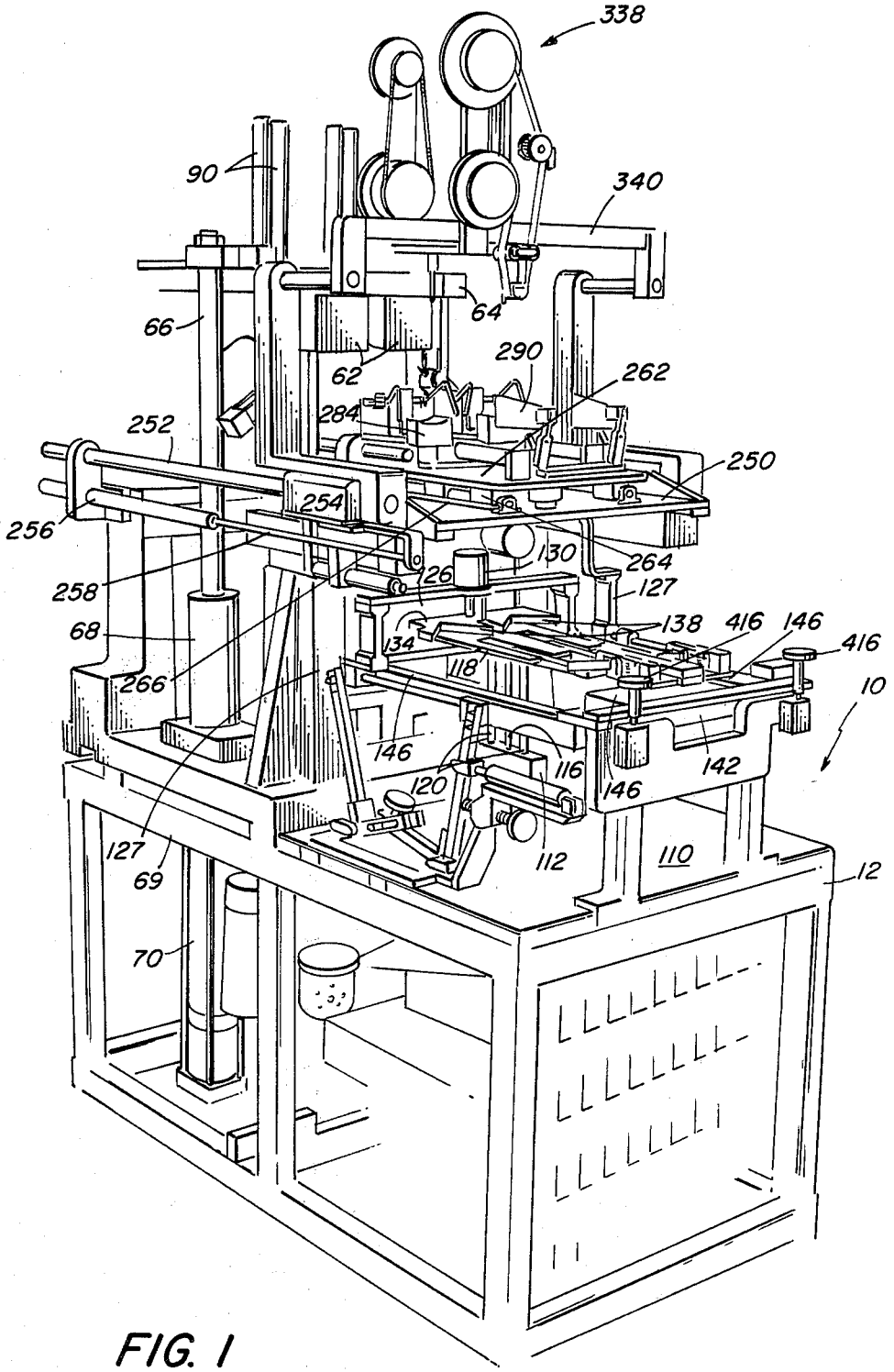
FIG. 1 is an isometric view looking at the front of the machine of this invention.
Figure 2:
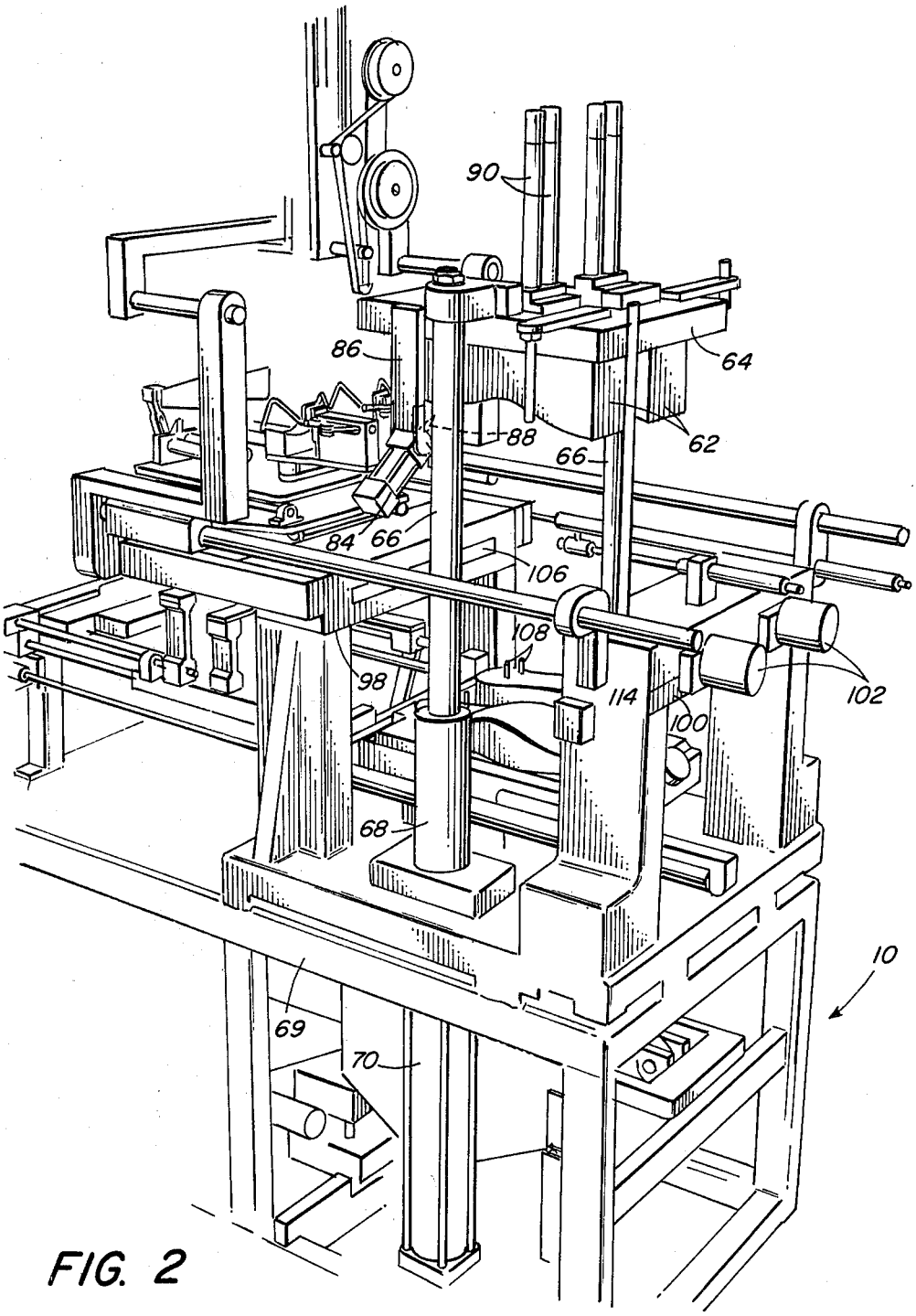
FIG. 2 is an isometric view looking at the back of the machine.
Figure 3:
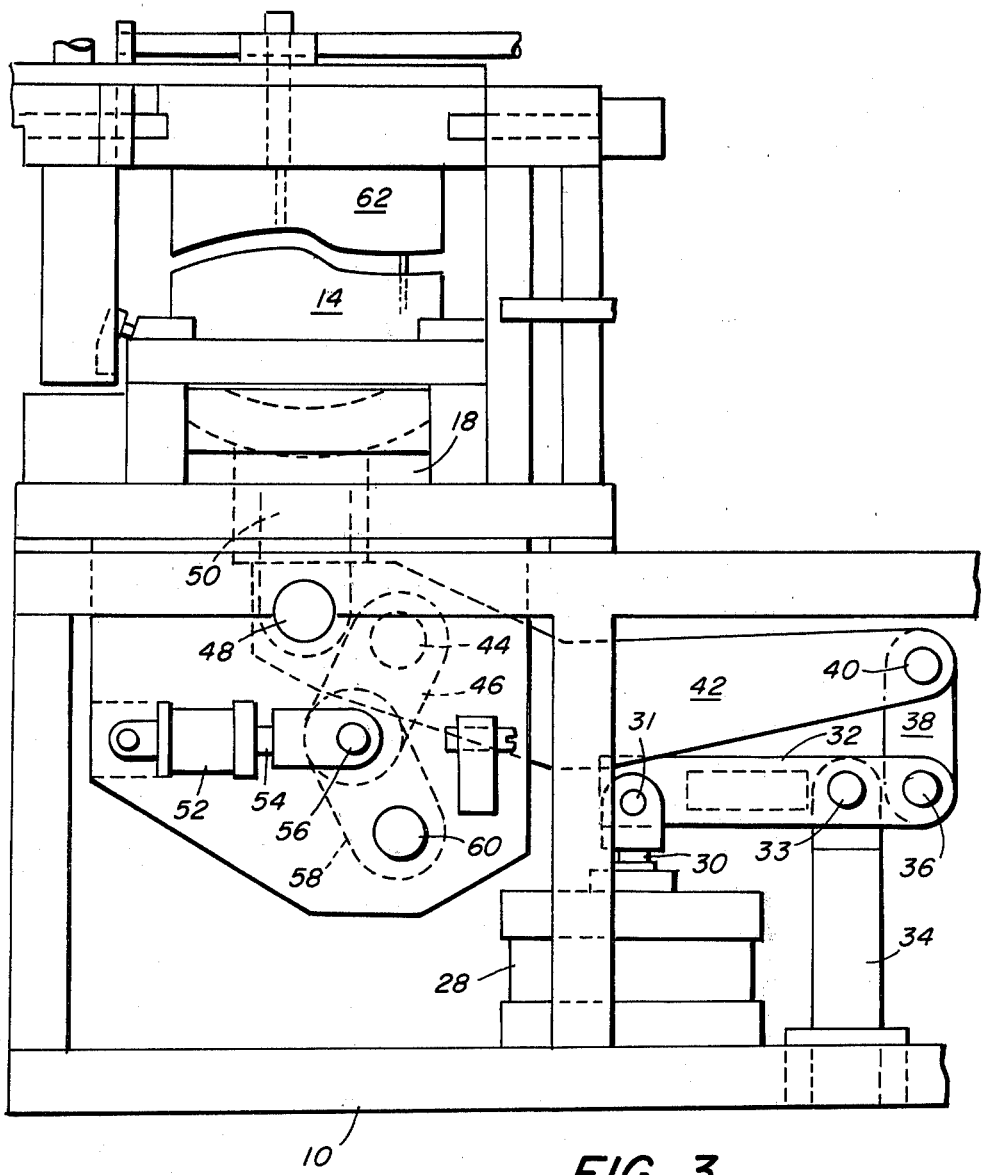
FIG. 3 is a view of a mechanism for closing the molds on the insole.

Referring to FIGS. 1–3, the machine comprises a frame 10 having an end 12. The end 12 is intended to face the operator during the machine operation. The parts of the machine closest to the operator will be considered to be the front of the machine and the parts of the machine furthermost from the operator will be considered to be the back of the machine. Movements of machine elements towards the operator will be considered to be "forward" movements and movements of machine elements away from the operator will be considered to be "rearward" movements.

The machine is intended to operate on a left foot shoe assembly and a right foot shoe assembly. The machine therefore has two sets of mechanisms for operating on the shoe assembly which are duplicates of each other apart from variations needed to accommodate one set of mechanisms for the left foot shoe assembly and the other set of mechanisms for the right foot shoe assembly. Therefore, in the following description, it is to be understood that while reference is made to one mechanism, this mechanism is duplicated in the machine.

Figure 4:
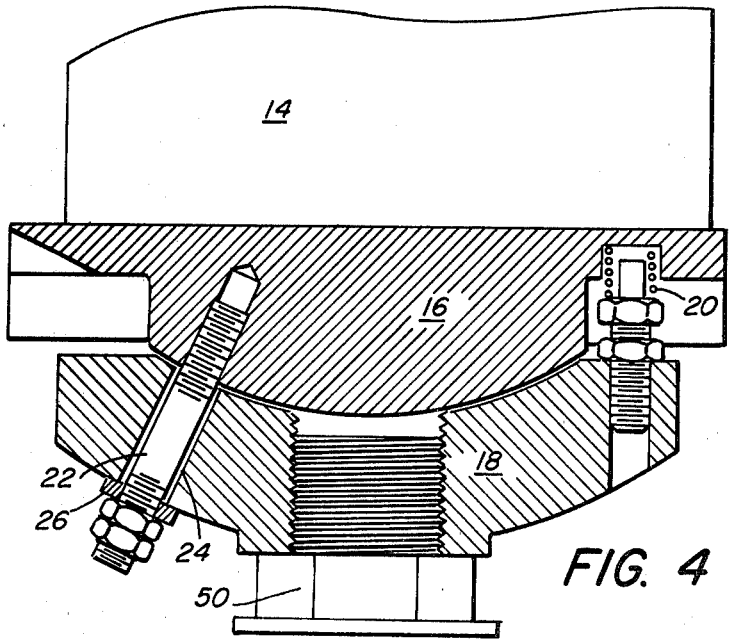
FIG. 4 is a partially sectional elevation of the mount for the lower mold.

A lower mold 14 (FIG. 3) is mounted in the back of the frame 10 for heightwise movement. The mold 14, as shown in FIG. 4, is mounted to a mount 16 and the mount 16 is located above a base 18. A plurality of springs 20, interposed between the mount 16 and the base 18, yieldably urge the mount 16 upwardly of the base 18. A plurality of studs 22, threaded into the mount 16, extend downwardly of the mount 16 through openings 24 in the base 18, the openings 24 having larger inside diameters than the outside diameters of the studs 22 to permit some movements of the studs 22 in the openings 24. A head 26, on the bottom of each stud 22, having a larger outside diameter than the inside diameter of its associated opening 24, bears against the bottom of the base 18 to thus limit the extent of upward movement of the mount 16 and the lower mold 14 relative to the base 18. The springs 20 and the studs 22 thus mount the mount 16 and the lower mold 14 for limited universal movement relative to the base 18 as permitted by the movements of the studs 22 in the openings 24.

Referring to FIG. 3, a pneumatic motor 28, mounted to the frame 10, has an upwardly extending piston rod 30 that is pivoted by a pin 31 to a lever 32. The lever 32 is pivoted intermediate its ends by a pin 33 to a stand 34 that is affixed to the frame 10. The end of the lever 32 remote from the rod 30 is pivoted by a pin 36 to a link 38. The distance between the pins 31 and 33 is substantially greater than the distance between the pins 33 and 36 so that the force applied by the lever 32 to the link 38 is substantially greater than the force applied by the piston rod 30 to the lever 32 pursuant to upward movement of the piston rod 30 by the motor 28. The end of the link 38 remote from the pin 36 is pivoted by a pin 40 to an end of a lever 42 that is pivoted intermediate its ends by a pin 44 to a lever 46. The end of the lever 42 remote from the pin 40 is pivoted by a pin 48 to a rod 50 that is attached to the base 18, the rod 50 being mounted for heightwise movement to thereby permit heightwise movement of the lower mold 14. The distance between the pins 40 and 44 is substantially greater than the distance between the pins 44 and 48 so that the force applied by the lever 42 to the rod 50 and thus the lower mold 14 is substantially greater than the force applied to the lever 42 by the link 38.

A pneumatic motor 52, mounted to the frame 10, has a piston rod 54 that is pivoted by a pin 56 to the lever 46 and to a lever 58, the end of the lever 58 remote from the pin 56 being pivoted to the frame 10 by a pin 60. The levers 46 and 58 form a toggle linkage so that movement of the piston rod 54, pursuant to actuation of the motor 52, can cause raising or lowering of the pin 44 to thereby swing the lever 42 about the pin 40 and thus raise or lower the rod 50 and the lower mold 14.

Figure 5:
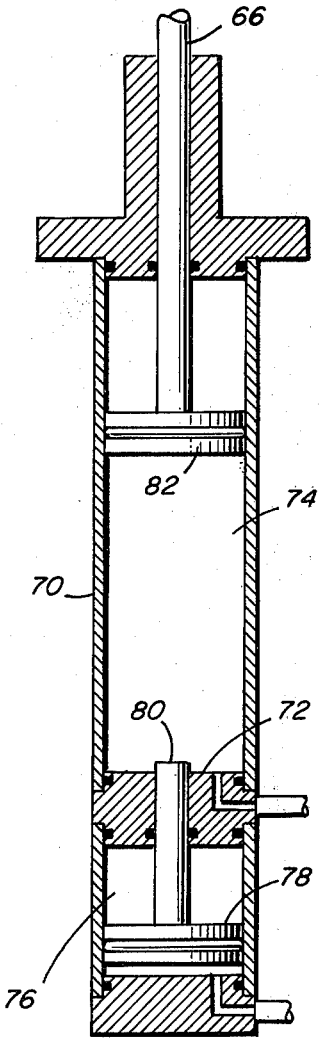
FIG. 5 is a section of a mechanism for effecting heightwise movement of the upper mold.

An upper mold 62, mounted to a block 64 (FIGS. 1 and 2), is in vertical registration with the lower mold 14. The block 64 is secured to a pair of posts 66. Each post 66 is slidable in a bushing 68 that is anchored to a plate 69 of the frame 10. A cylinder 70, also anchored to the plate 69 and extending below the plate 69, is in alignment with its associated bushing 68. Referring to FIG. 5, each cylinder 70 has a block 72 fixed therein that divides the cylinder 70 into an upper compartment 74 and a lower compartment 76.

A piston 78, movable heightwise in the lower compartment 76, has a piston rod 80 extending upwardly therefrom through an opening in the block 72 into the upper compartment 74. The bottom of each post 66 is secured to a piston 82 that is movable heightwise in the upper compartment 74. The compartments 74 and 76 are so connected to a source of air under pressure as to enable the pressurized air to move the pistons 82 upwardly and downwardly in the upper compartments 74 and to move the pistons 72 upwardly and downwardly in the lower compartments 76.

A pneumatic motor 84 (FIG. 2), mounted by a bracket 86 to the block 64, has an upwardly extending plunger 88 secured to its piston rod. The plunger 88 is in intersecting relationship with the bottom of the upper mold 62 and is so inclined that it is out of registry with the molds 14 and 62 when it is retracted into the motor 84.

Figure 6:
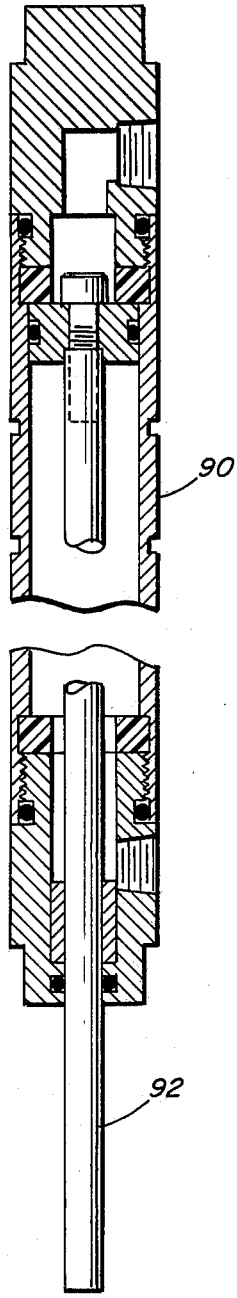
FIG. 6 is a section of a pneumatic motor that is mounted to the upper mold.
Figure 7:
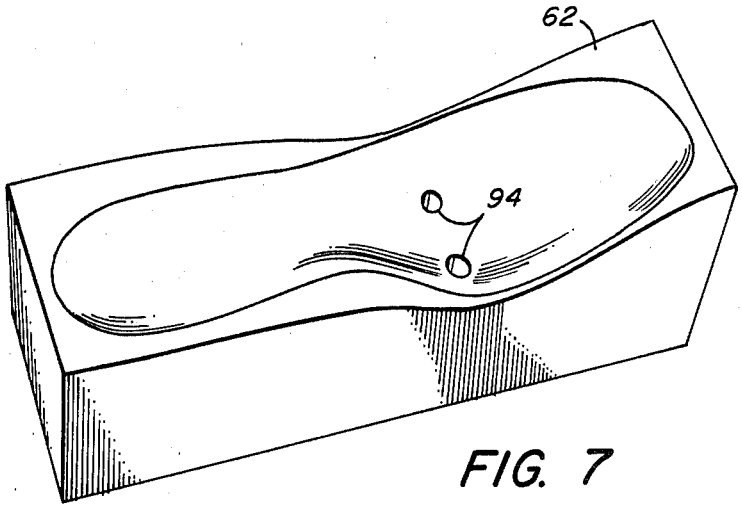
FIG. 7 is an isometric view of the upper mold.

As shown in FIG. 2, a pair of pneumatic motors 90 are mounted to the block 64 above the upper mold 62. The piston rod 92 (FIG. 6) of each motor 90 is in alignment with a hole 94 (FIG. 7) extending through the upper mold 62. The motors 90 are so dimensioned that when the piston rods 92 are retracted into the motors 90 they lie in the holes 94 above the bottom of the upper mold 62 and when they are projected out of the motors 90 they extend below the upper mold bottom surface.

Figure 8:
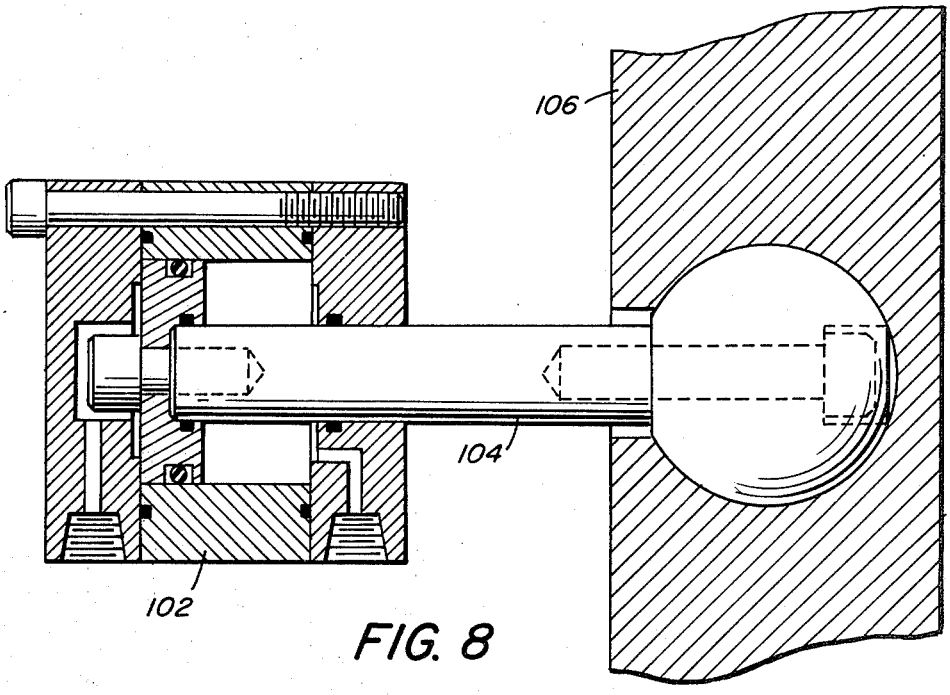
FIG. 8 is a section of a plate that is movable across the top of the upper mold and a drive motor for the plate.

Referring to FIG. 2, a front stand 98 and a back stand 100 are respectively mounted to the plate 69 on the front and back sides of the vertical path of movement of the block 64. Two pneumatic motors 102 are mounted to the front of the front stand 98 and the back of the back stand 100. The piston rods 104 (FIG. 8) of the motors 102 mounted to the front stand 98 are connected to a plate 106 that is so slidably mounted to the front stand 98 as to be retracted into the front stand 98 when these piston rods are retracted into their motors 102 and to be projected rearwardly of the front stand 98 when these piston rods are projected out of their motors 102. Similarly, the piston rods 104 of the motors 102 mounted to the back stand 100 are connected to a plate 106 (not shown) that is so slidably mounted to the back stand 100 as to be retracted into the back stand 100 when these piston rods are retracted into their motors 102 and to be projected forwardly of the back stand 100 when these piston rods are projected out of their motors.

As shown in FIG. 2, a pair of pins 108 extend upwardly of the lower mold 14. The pins 108 are resiliently mounted so as to project upwardly to the top surface of the mold 14 and so as to be depressible into the mold 14 beneath its top surface when a downwardly directed force is applied to the pins.

Referring to FIGS. 1 and 9–11, a table 110 is located at the front of the frame 10. A block 112, mounted to the table 110, has a pneumatic motor 114 depending therefrom. The upwardly extending piston rod 116 of the motor 114 is secured to a platform 118 that is guided for heightwise movement by a guide rods 120 that depend from the platfrom 118 into holes in the block 112. The platform 118 has three laterally spaced and forwardly extending fingers consisting of a central finger 122 and side fingers 124.

A back carriage 126 is mounted by lungs 127 on guide bars 128 for forward-rearward movement. A pneumatic motor 130, mounted to the carriage 126, has a downwardly directed piston rod 132 that is connected to a back gauge block 134. A pin 136, connected to and extending upwardly of the back gauge block 134 through the carriage 126, guides the gauge block 134 for vertical movement pursuant to actuations of the motor 130. A forwardly facing V-shaped back gauge 138 is formed on the gauge block 134 and is located above the platform 118.

Figure 9:
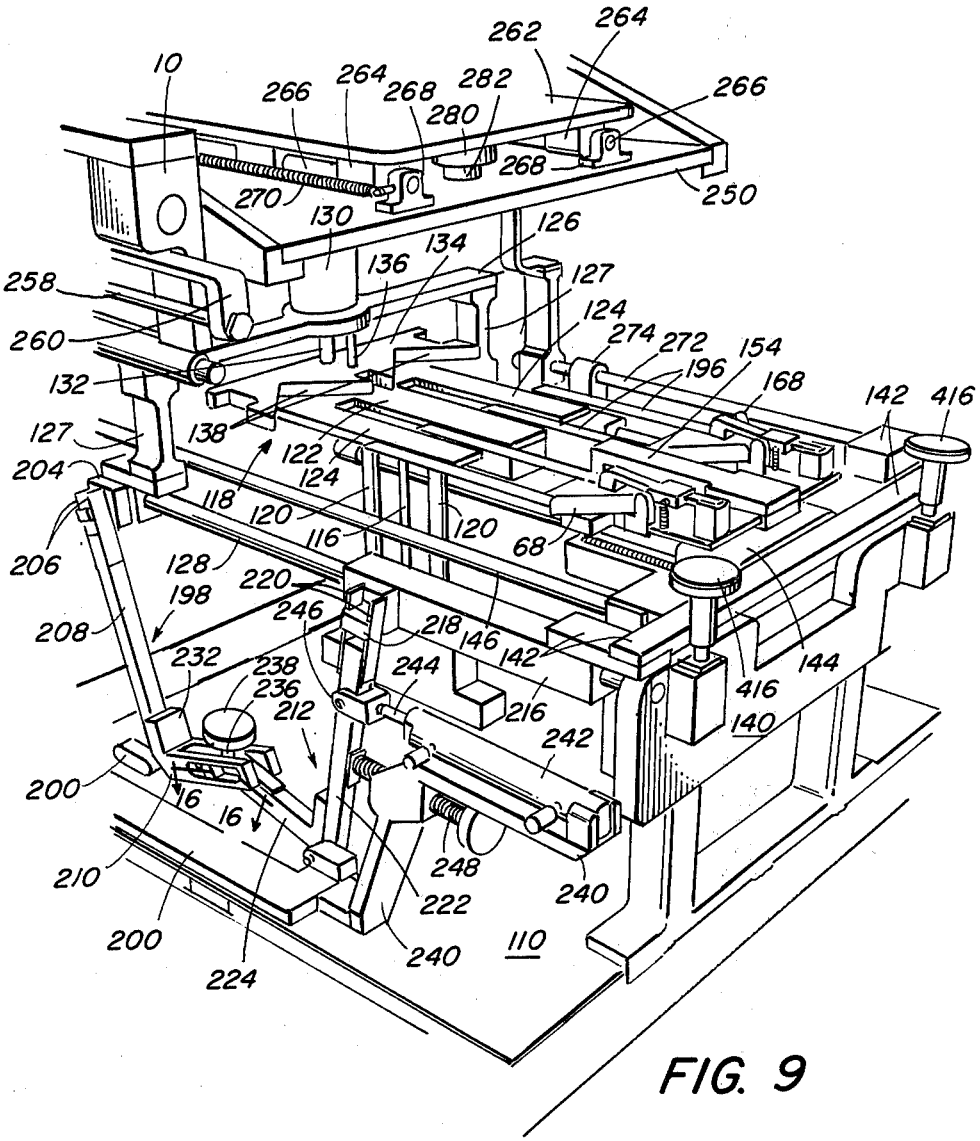
FIG. 9 is an isometric view of the machine showing the insole support and the insole shifting means.
Figure 10:
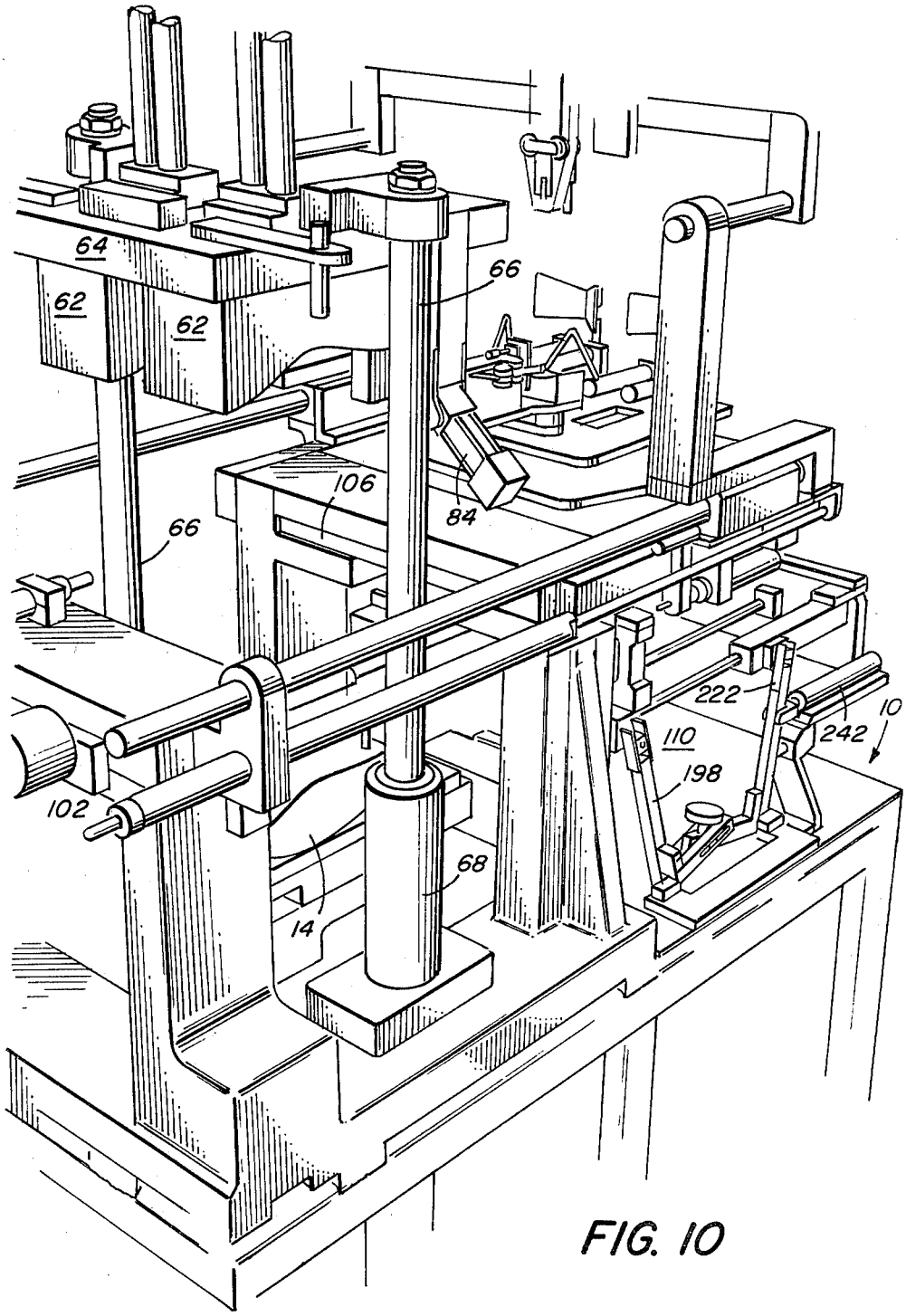
FIG. 10 is an isometric view looking at the opposite side of the back of the machine from the side looked at in FIG. 2.
Figure 11:
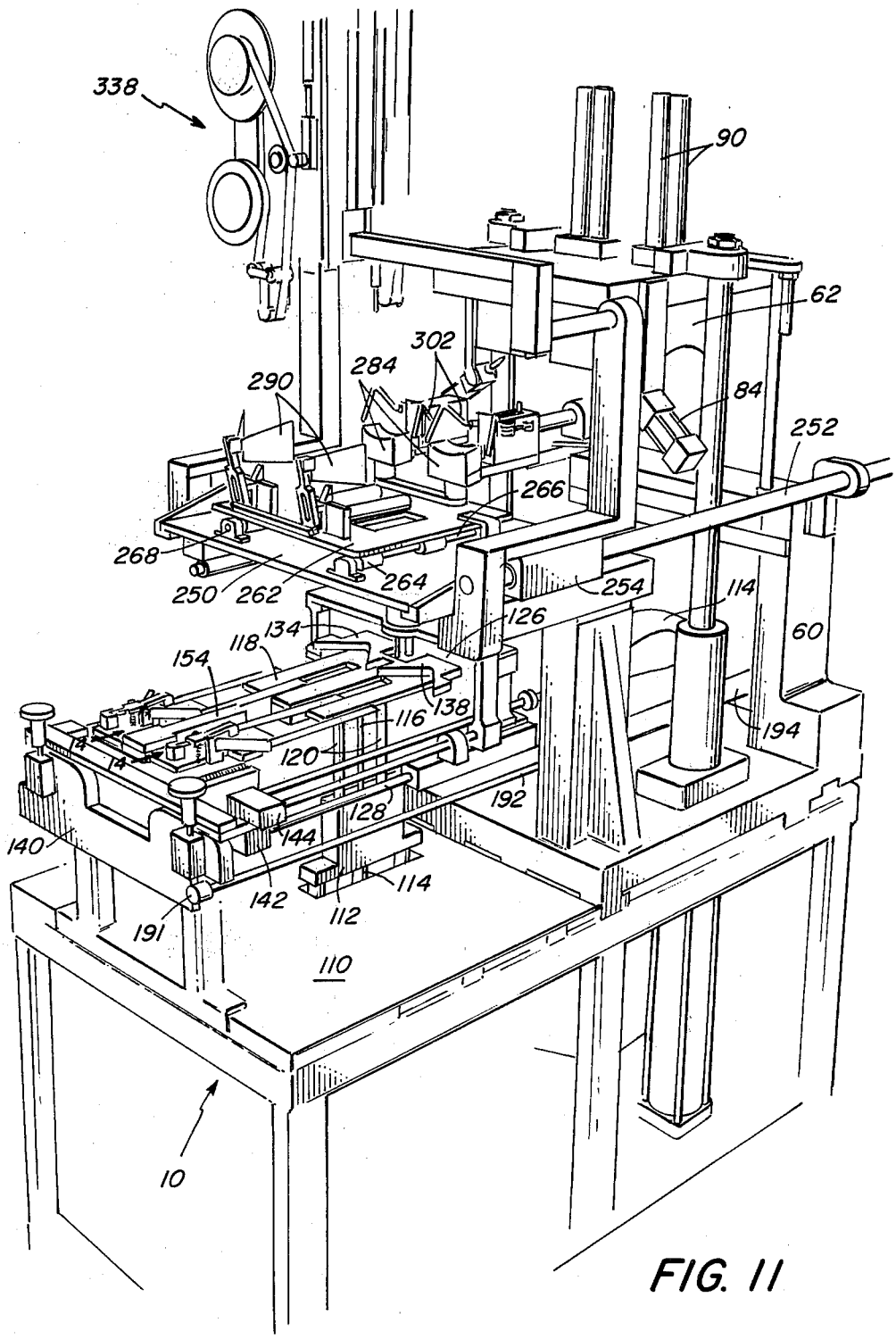
FIG. 11 is an isometric view looking at the opposite side of the front of the machine from the side looked at in FIG. 1.
Figure 12:
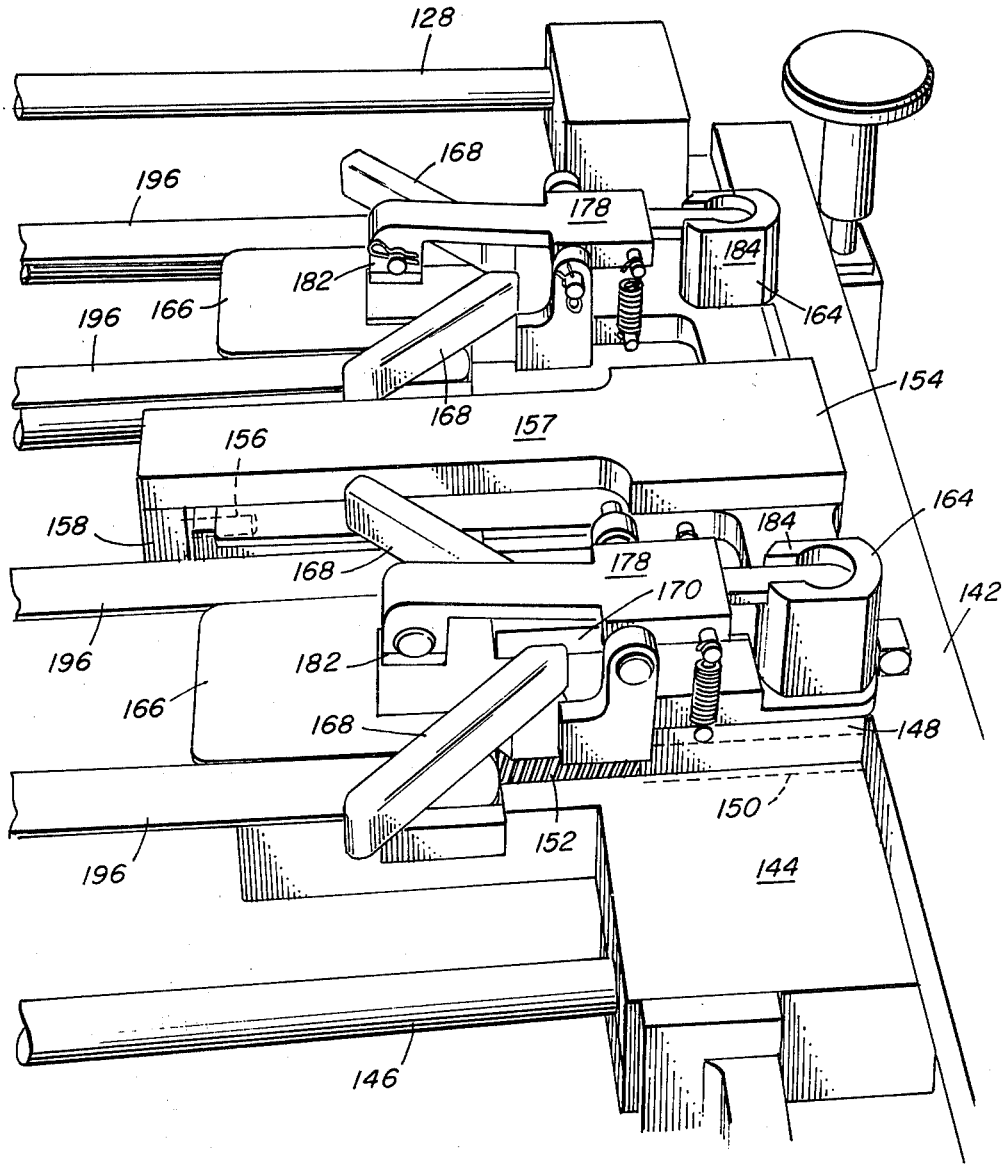
FIG. 12 is an isometric view, to a larger scale than FIG. 9, of a part of the insole support and the insole shifting means.
Figure 14:
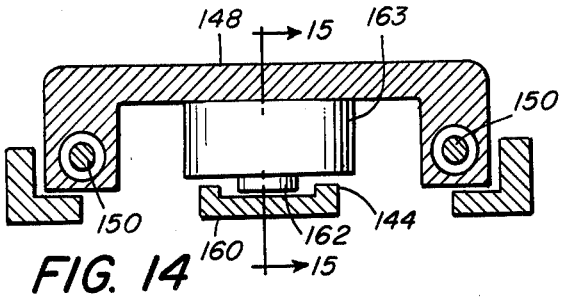
FIG. 14 is a section taken on the line 14—14 of FIG. 11.
Figure 15:
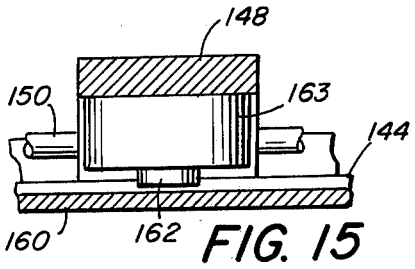
FIG. 15 is a section taken on the line 15–15 of FIG. 14.

Referring to FIGS. 9, 11 and 12, the fronts of the guide bars 128 are mounted to a fixed plate 140 at the front of the machine above the table 110. A frame 142 is mounted for forward-rearward sliding movement on the guide bars 128 and is located rearwardly of the plate 140. A carrier 144, located rearwardly of the frame 142, is slidably mounted for forward-rearward movement on guide bars 146 (FIGS. 1 and 12). The top of the carrier 144 is located below the bottom of the frame 142 so that the frame 142 can move (as described below) above the top of the front of the carrier 144. A sub-carrier 148 is mounted to the carrier 144 for forward-rearward movement on a pair of guide bars 150 (see FIG. 14). Springs 152, only one of which is shown in FIG. 12, entwined above the guide bars 150 between the sub-carrier 148 and the front of the carrier 144 yieldably urge the sub-carrier 148 forwardly to a position of engagement on the front of the sub-carrier 148 with the back of the frame 142. A front gauge block 154 is slidably mounted to the sub-carrier 148 for forward-rearward movement. The piston rod 156 of a pneumatic motor mounted on a center strut 157 of the sub-carrier 148 is so connected to a prong 158 of the front gauge block 154 mounted to the center strut 157 as to effect forward-rearward movement of the front gauge block 154 with respect to the sub-carrier 148. As shown in FIGS. 14 and 15, a forwardly-rearwardly extending bar 160 on the carrier 144 is positioned to receive the downwardly projecting piston rod 162 of a pneumatic motor 163 mounted to the sub-carrier 148.

Figure 13:
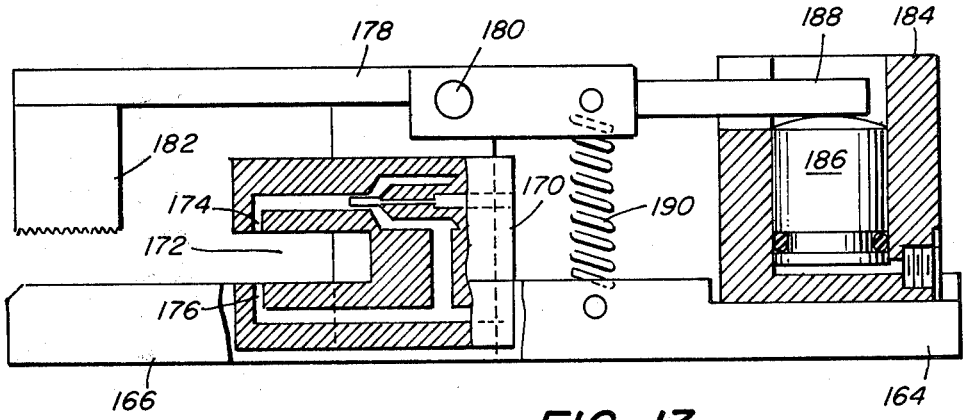
FIG. 13 is a side elevation of a part of the insole shifting means shown in FIG. 12.

Referring to FIGS. 12 and 13, the front gauge block 154 is formed of a wing 164 located on a side of the center strut 157. The wing 164 includes a rearwardly extending plate 166. A rearwardly facing and rearwardly divergent V-shaped gauge 168 is located above the plate 166. The gauge 168 is in forward-rearward alignment with the gauge 138. A gap sensor 170, supplied by Clippard Instrument Laboratory, Inc. of Cincinnatti, Oh., is mounted to the wing 164 at the vertex of the gauge 168. The gap sensor 170 has a rearwardly facing gap 172 that is intersected by aligned ports 174 and 176 through which air under pressure flows. The gap sensor 170 is so constructed that the air stream flow between the ports 174 and 176 is so associated with valves (not shown) that the placing of an object between the ports 174 and 176, as described below, to block the air stream will cause actuation of the valves and thereby actuate certain of the pneumatic motors of the machine.

As shown in FIG. 13, a forwardly-rearwardly extending arm 178 is pivoted between its ends by a pivot pin 180 to the wing 164 for swinging movement in a vertical plane. The back of the arm 178 has a clamp 182 mounted thereto that is movable towards the plate 166 rearwardly of the gap sensor 170 and between the side ends of the associated gauge 168. A pneumatic motor 184, mounted on the front of the wing 164, has a piston 186 that is vertically movable in intersecting relationship with the front end 188 of the arm 178. A spring 190, extending between the wing 164 and the arm 178, yieldably urges the arm front end 188 against the piston 186.

As shown in FIG. 11, a lug 191 of the carrier 144 is secured to the piston rod 192 of a pneumatic motor 194 mounted to the frame 10 whereby actuation of the motor 194 effects forward-rearward movement of the carrier 144 on the guide bars 146.

As shown in FIGS. 9 and 12, the plate 166 has a pair of rearwardly directed fingers 196 mounted thereto with each pair of fingers 196 straddling the side finger 124.

Figure 16:
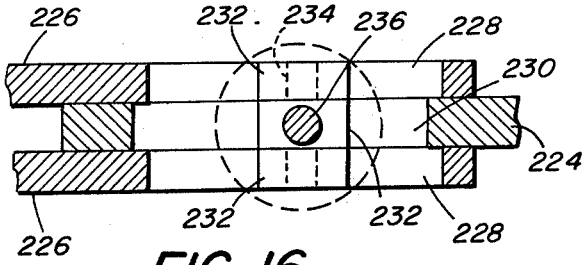
FIG. 16 is a section taken on the line 16—16 of FIG. 9.

Referring to FIG. 9, a two-armed lever 198 is pivoted to a bracket 200 secured to the table 110. A head 204, pivoted to one of the lugs 127, slidably receives a pair of prongs 206 at the top of an arm 208 of the lever 198. Another arm 210 of the lever 198 extends rearwardly of the arm 208. Another two-armed lever 212, located forwardly of the lever 198, is pivoted to the bracket 200. A sleeve 216, secured to and extending rearwardly of the frame 142 and slidable on a guide bar 128, has a head 218 pivoted thereto that slidably receives a pair of prongs 220 at the top of an arm 222 of the lever 212. Another arm 224 of the lever 212 extends rearwardly of the arm 222. The front of the lever arm 210 is divided into a pair of fingers 226 (FIG. 16) that straddle the back of lever arm 224. Each finger 226 has a slot 228 and the back of the lever arm 224 has a slot 230. A nut 232 is slidably and non-rotatably received in each of the slots 228 and 230 with the nuts being rotatably mounted on a pin 234. A stud 236, threaded into the nut 232 in the slot 230, may be rotated by a knob 238 to lock this nut in the slot 230 and thus lock all the nuts 232 in adjusted position in the slots 228 and 230. The pin 234 thus forms an adjustable pivotal connection between the lever arms 210 and 224. A stand 240, secured to the bracket 200, has a pneumatic motor 242 pivoted thereto. The rearwardly directed piston rod 244 of the motor 242 is pivoted by a pivot pin 246 to the mid-portion of the lever arm 222. A stud 248, threaded into the stand 240, is so located as to be in abutting relation with the front of the lever arm 222 and thus limit the extent of forward movement of the lever arm 212 by the motor 242.

Figure 17:
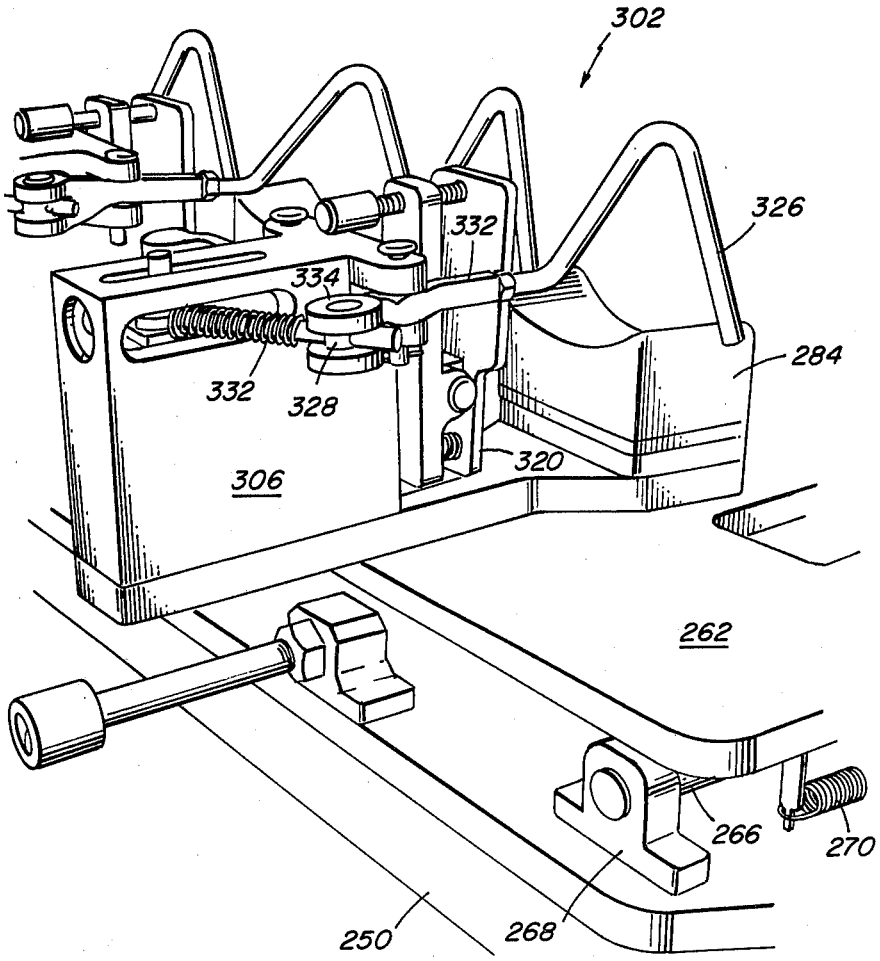
FIG. 17 is an isometric view showing a toe aligner.

Referring to FIGS. 1, 9 and 11, a base 250 above the block 118 and forwardly of the molds 14 and 62 is mounted for forward-rearward movements on guide bars 252 by way of sleeves 254 on the base 250 being slidably mounted on the guide bars 252. A pneumatic motor 256, mounted to the frame 10, has a forwardly directed piston rod 258 that is connected to a lug 260 that in turn is connected to a sleeve 254 to thereby enable the motor 256 to effect forward-rearward movements of the base 250. A plate 262 is slidably mounted on the base 250 for forward-rearward movement by means of lugs 264 dependent from the plate 262 that are slidable on guide bars 266 mounted to the base 250. The front and backs of the guide bars 266 are mounted to mounts 268 secured to the base 250 (see FIG. 17). Springs 270 mounted at their fronts to the mounts 268 at the fronts of the base 250 and at their backs to the backs of the plate 262 yieldably urge the plate 262 forwardly to a position wherein the lugs 264 abut the front mounts 268.

Figure 18:
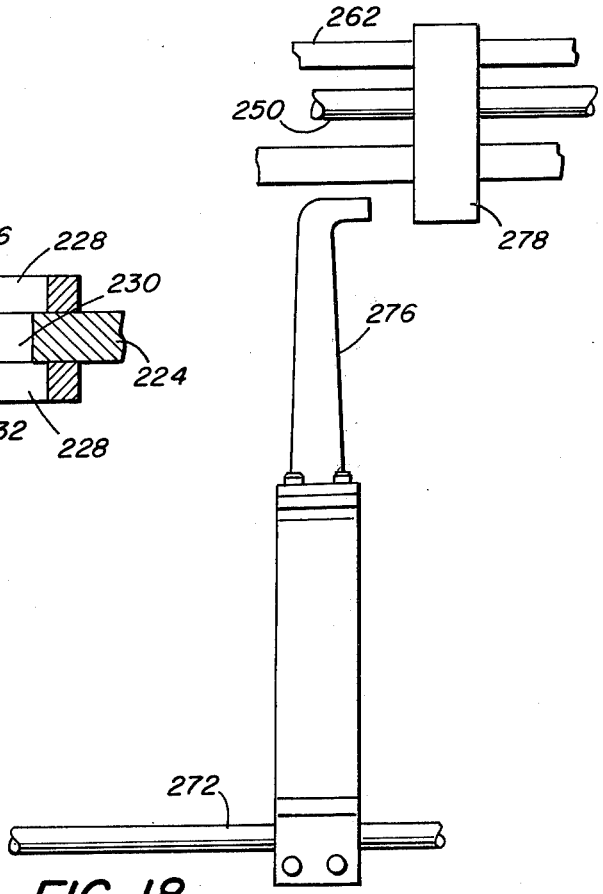
FIG. 18 is an elevation view of a striker and a lug for adjusting the position of a last support.

A bar 272 (FIGS. 9 and 18), affixed to and extending rearwardly of the frame 142, is slidably guided for forward-rearward movement in a bushing 274 that is secured to one of the lugs 127. A striker 276, secured to the back of the bar 272, is located forwardly of and in forward-rearward registry with a lug 278 that is secured to and depends from the plate 262.

As shown in FIG. 9, a pneumatic motor 280, affixed to the bottom of the plate 262, has a downwardly directed piston rod 282 that is engageable with the base 250 in response to actuation of the motor 280.

Figure 19:
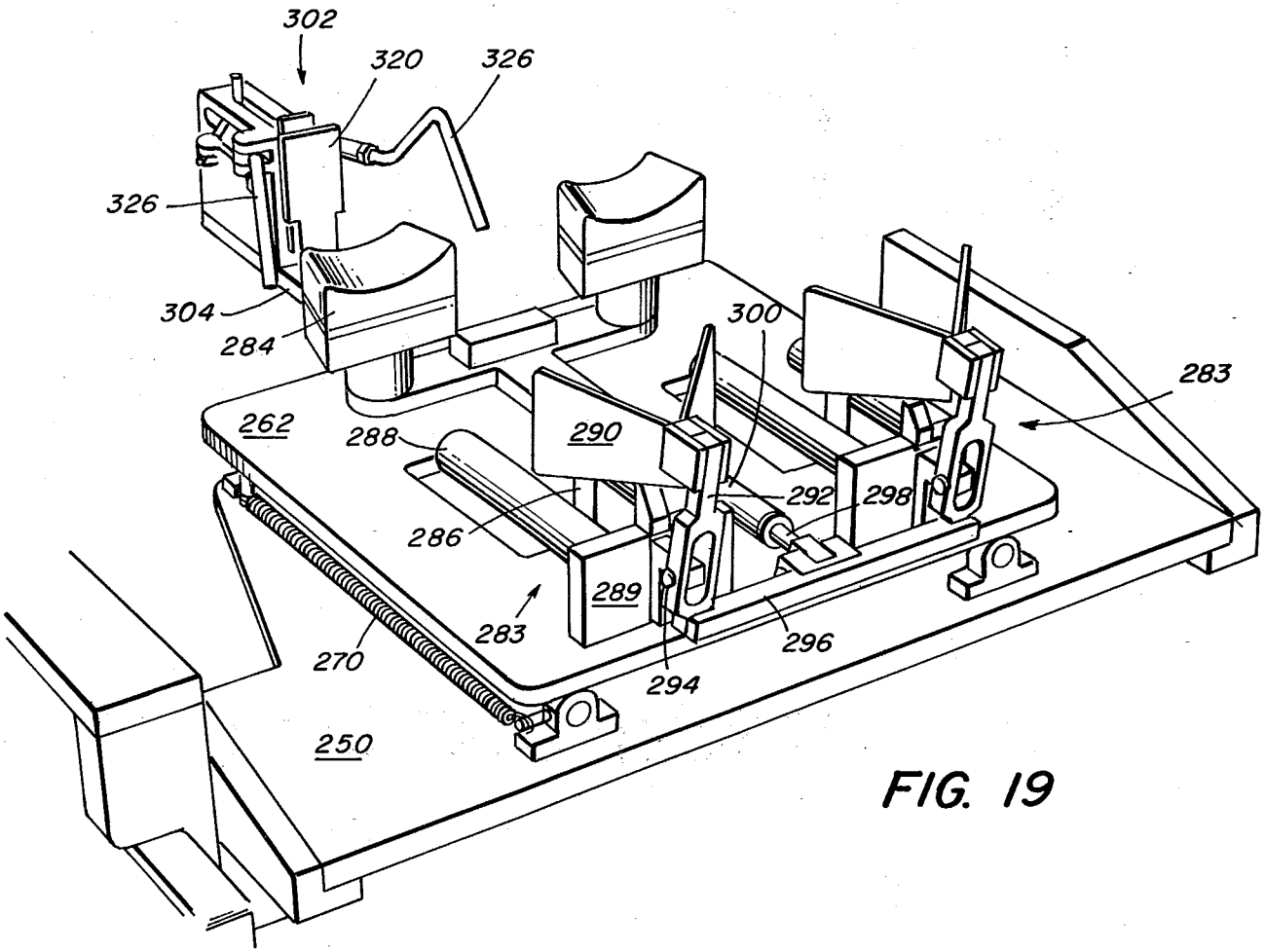
FIG. 19 is an isometric view of the last support.
Figure 21:
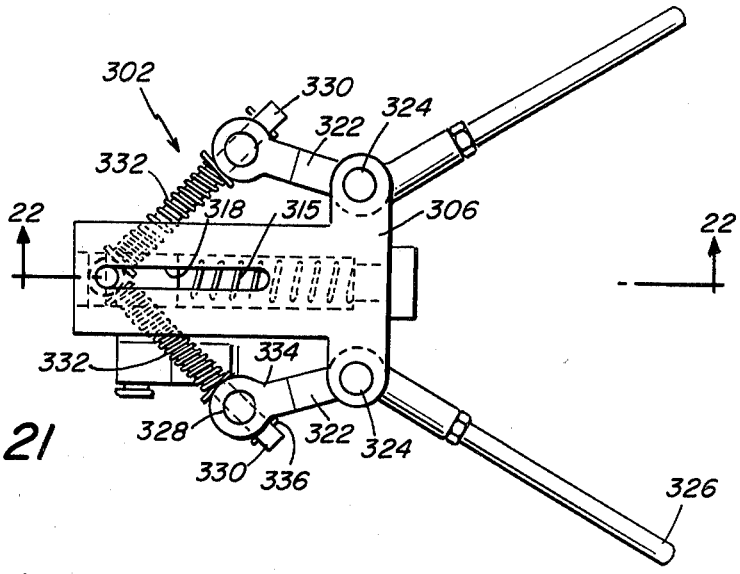
FIG. 21 is a plan view taken along the line 21—21 of FIG. 20.
Figure 20:
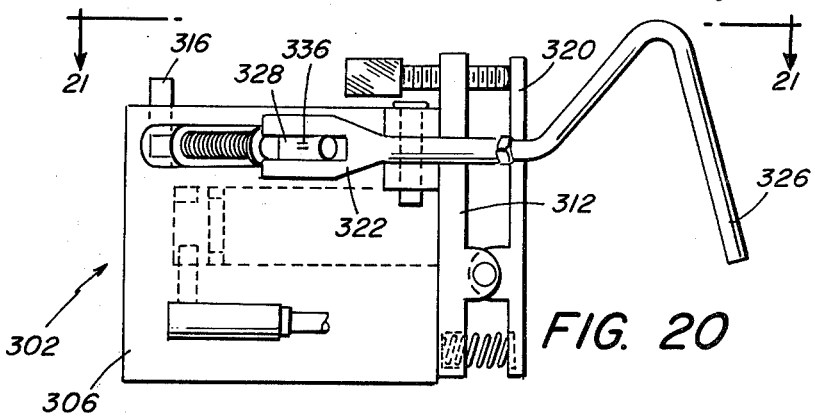
FIG. 20 is an elevation of the toe aligner.
Figure 22:
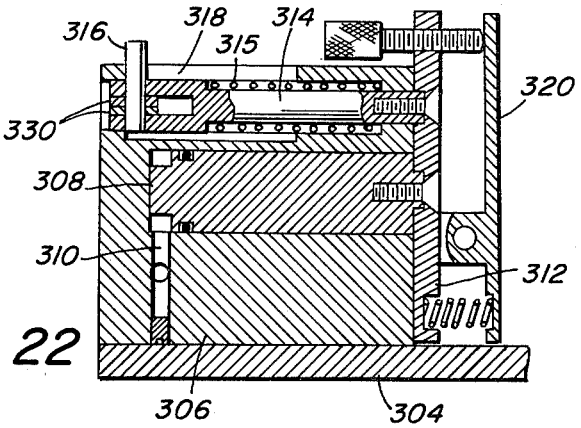
FIG. 22 is a section taken along the line 22—22 of FIG. 21.

Referring to FIG. 19, a last support 283 is mounted to the top of the plate 262. The last support comprises a toe rest 284, a last pin 286 and bars 288, affixed to a bracket 289, that extend in forward-rearward directions on opposite sides of the last pin 286. A forked heel aligner 290, located forwardly of the last pin 286 is mounted to a mount 292. The mount 292 is pivoted by a pin 294 to the bracket 289 and is connected by a cross-piece 296 to the piston rod 298 of a pneumatic motor 300 that is mounted on the plate 262 whereby actuations of the motor 300 may effect forward-rearward movements of the heel aligner 290 about the axis of the pin 294.

Referring to FIGS. 19–22, a toe aligner 302 is mounted to the plate 262 and is located rearwardly of the toe rest 284 on a bar 304. The toe aligner 302 is comprised of a housing 306 secured to the bar 304. A piston 308 is mounted in the housing 306 for forward-rearward movement. A port 310 in the housing 306 is in communication with the front of the piston 308 and with a source of air under pressure whereby admission of pressurized air to the port 310 effects forward movement of the piston 308, The front of the piston 308 is secured to a plate 312. The top of the plate 312 is secured to a plunger 314 that is mounted in the housing 306 for forward-rearward movement and is yieldably urged rearwardly by a spring 315. A pin 316, affixed to plunger 314, is guided in a forwardly-rearwardly extending slot 318 in the housing 306. A front aligner plate 320 is mounted to and is located forwardly of the plate 312. A lever 322 is pivoted by a pin 324 to each side of the front of the housing 306. A side aligner pin 326 is formed at the front of each lever 322. A pin 328 at the back of each lever 322 slidably receives the front of a rod 330. The back 334 of each rod 330 is formed into a loop that encircles the pin 316. A coil spring 332 on each pin 330 extends between the pin 316 and the back 334 of each lever 322 to yieldably urge the back 334 of each lever 322 outwardly along its associated pin 330 to a position determined by the engagement of each lever back 334 with a pin 336 that extends through each rod 330 outwardly of its associated lever back 334.

Figure 23:
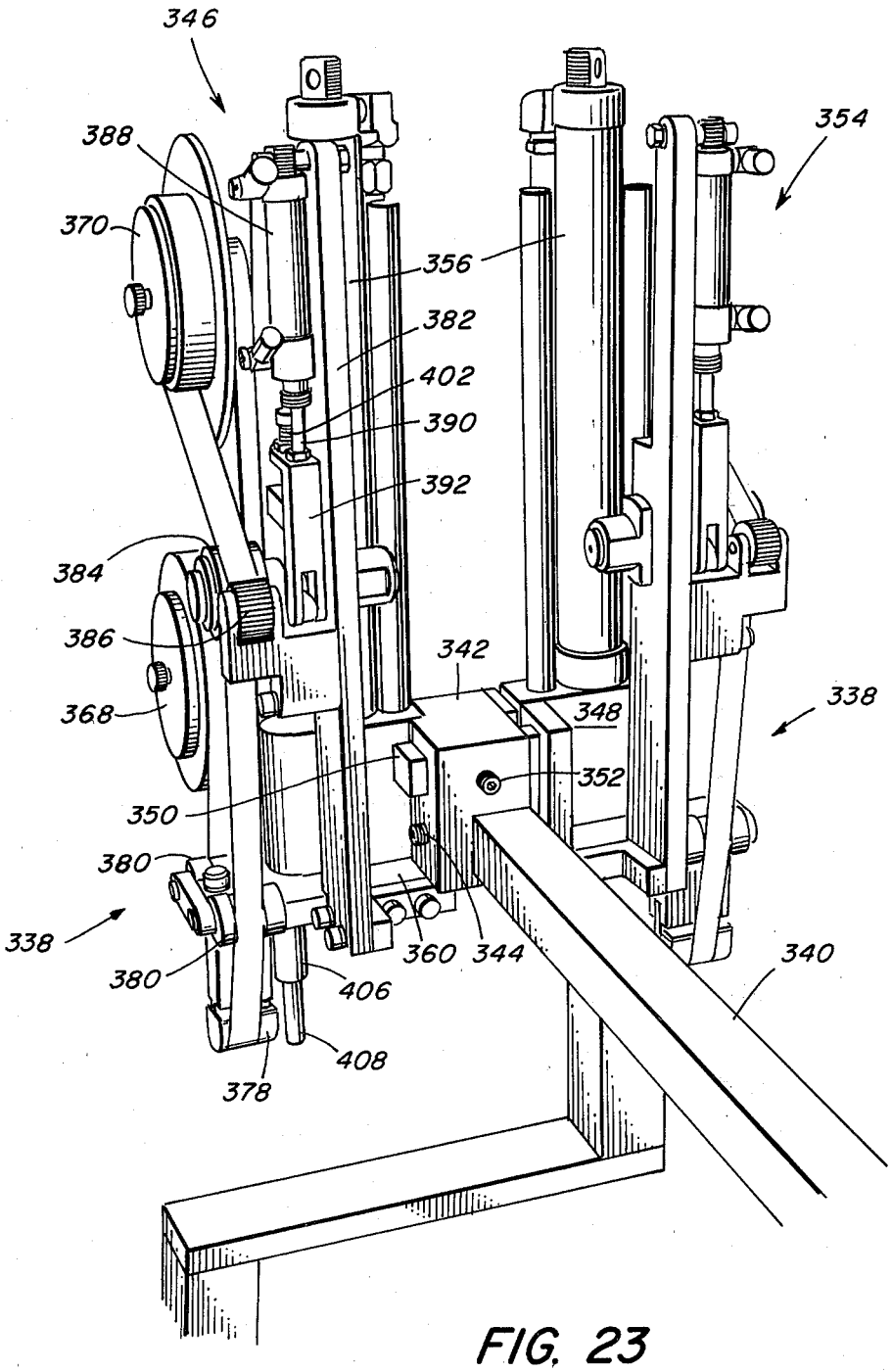
FIG. 23 is an isometric view of the adhesive applying mechanism looking from a side of the machine.

A pair of adhesive applying mechanisms 338 (FIG. 23) are associated with the shoe assembly support 283. FIG. 23 shows a cross bar 340 of the frame 10 on which a holder 342 is slidably mounted for lateral movement. The holder 342 can be secured in adjusted position on the cross bar 340 by a screw 344. A front adhesive applying mechanism 346 is mounted to the holder 342. Another holder 348 has a bar 350 that is slidably mounted in the holder 342 for forward-rearward movement. The bar 350 can be secured in adjusted position, to thereby secure the holder 348 in adjusted position, by a screw 352. A back adhesive applying mechanism 354 is mounted to the holder 348.

Each of the mechanisms 346 and 354 comprises a pneumatic motor 356 (see FIG. 27) mounted to its associated holder 342 or 348. The downwardly depending piston rod 358 of each motor 356 is secured to a plate 360. A pair of guide bars 362 and 364 are mounted to the plate 360 and extend upwardly thereof through its associated holder 342 or 348 to thereby guide the plate 360 for vertical movements in response to actuations of the motor 356.

Figure 24:
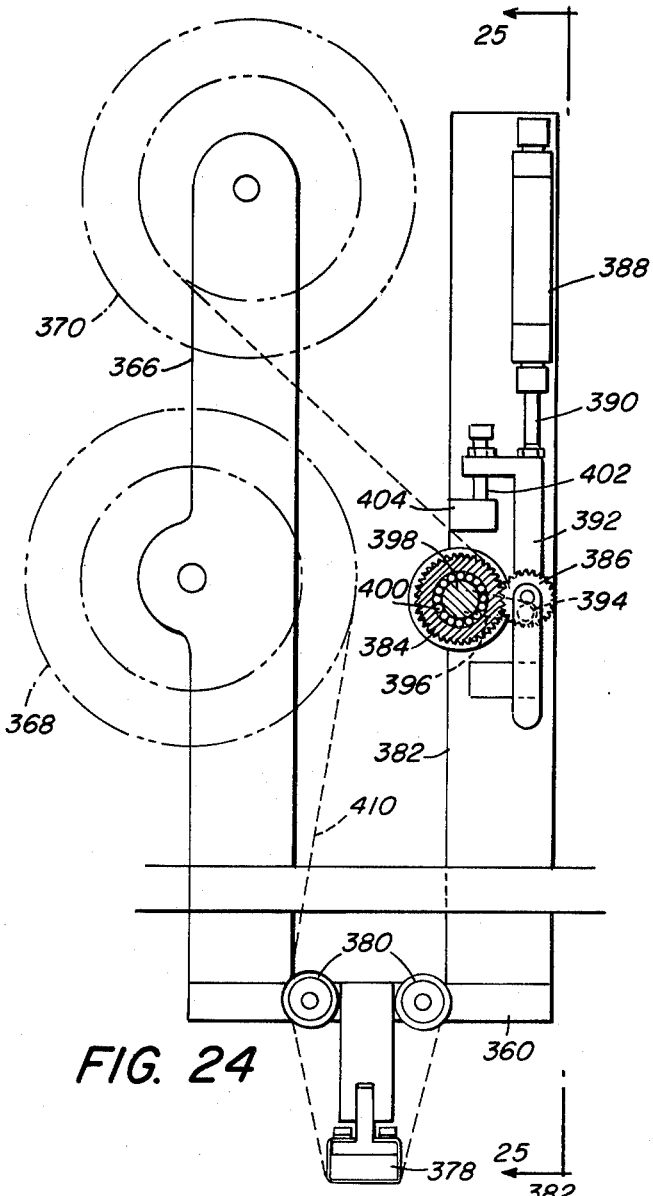
FIG. 24 is an elevation of the adhesive applying mechanism.
Figure 25:
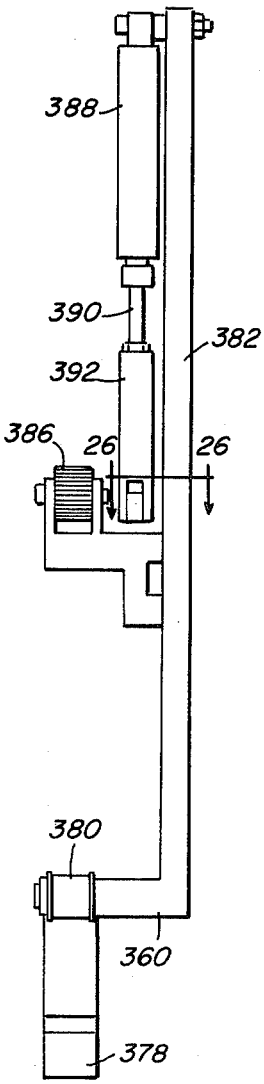
FIG. 25 is a view taken along the line 25—25 of FIG. 24.
Figure 26:
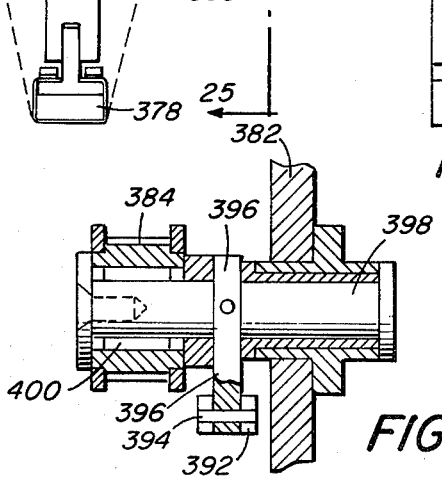
FIG. 26 is a section taken along the line 26—26 of FIG. 25.
Figure 28:
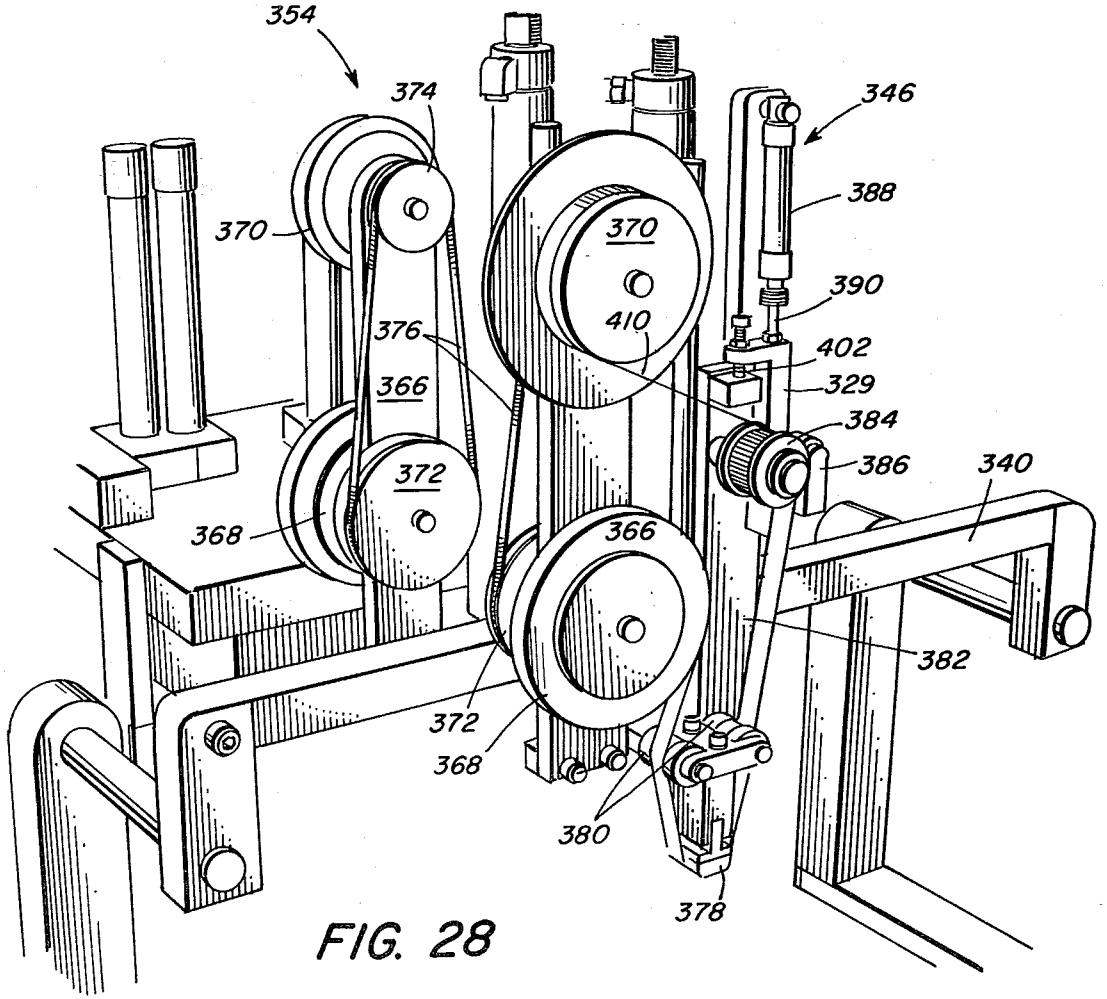
FIG. 28 is an isometric view of the adhesive applying mechanism looking from the front of the machine.

Referring to FIGS. 24 and 28, a post 366 is secured to and extends upwardly of the plate 360. An unwinding reel 368 is rotatably mounted to a lower portion of the post 366 and a take-up reel 370 is rotatably mounted to the post 366 above the reel 368. A relatively large diameter pulley 372 is mounted so as to be coaxial with and rotate in unison with the reel 368. A relatively small diameter pulley 374 is mounted so as to be coaxial with and rotate in unison with the reel 370. A flexible chain 376 extends about the pulleys 372 and 374. An applicator pad 378 (FIGS. 24, 25 and 28) is mounted to and depends downwardly of the plate 360. A guide roll 380 is mounted to the plate 360 on opposite sides of and above the applicator pad 378. A post 382 is secured to and extends upwardly of the plate 360. The posts 366 and 382 are on opposite sides of the pad 378 and the rolls 380. A drive feed roll 384 and an idler feed roll 386 are rotatably mounted on the post 382. The rolls 384 and 386 have intermeshing teeth whereby the rotation of the roll 384 will cause rotation of the roll 386. A pneumatic motor 388 mounted to the top of the post 382 has a downwardly depending piston rod 390 that is connected to a clevis 392. Referring particularly to FIG. 26, the clevis 392 is pivoted by a pin 394 to a lever 396 which in turn is pinned to a shaft 398. The shaft 398 is rotatably mounted in the post 382 and the feed roll 384 is mounted to the shaft 398 with a one way clutch 400 interposed between the shaft 398 and the feed roll 384. The one way clutch 400 is so constructed that upward movement of the lever 396 to rotate the shaft 398 counterclockwise as seen in FIG. 24 will cause counterclockwise rotation of the roll 384 and downward movement of the lever 396 will have no effect on the roll 384. A bolt 402 threaded into the clevis 392 is in registry with a block 404 secured to the post 382 whereby the engagement of the bolt 402 with the block 404 limits the extent of downward movement of the clevis 392 by the motor 388.

Figure 27:
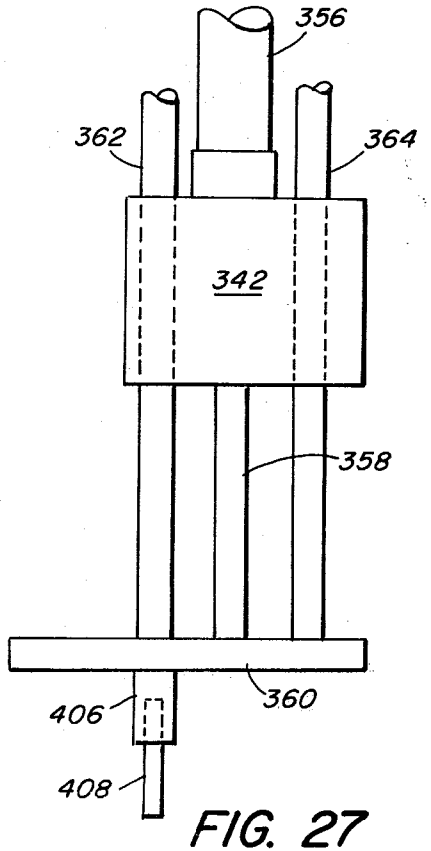
FIG. 27 is an elevation of a portion of the adhesive applying mechanism that incorporates a motor for effecting heightwise movement of the adhesive applying mechanism.

As seen in FIGS. 23 and 27, an extension 406 of the guide bar 362 extends below the plate 360 and a hold-down bar 408 is so mounted to the extension 406 as to be resiliently urged downwardly of the extension 406.

In the idle condition of the machine: the piston rod 30 is retracted into the motor 28 and the piston rod 54 is retracted into the motor 52 to thus maintain the lower mold 14 in a lowered position; the pistons 78 are in raised condition in the lower compartments 76 and the pistons 82 are in raised condition in the upper compartments 74 whereby the upper mold 62 is in a raised position; the plungers 88 are retracted into the motors 84; the piston rods 92 are retracted into the motors 90 and thus are retracted into the upper molds 62; the piston rods 104 are retracted into the motors 102 so that the plates 106 are retracted into the stands 98 and 100; the piston rod 116 is projected out of the motor 114 so that the platform 118 is in an upper position with the fingers 122, 124 substantially at the same level as the fingers 196; the piston rod 132 is projected out of the motor 130 so that the back gauge block 134 is bearing against the platform 118; the piston rod 156 is retracted into its associated motor in the center strut 157 so that the front gauge block 154 is in a forward position relative to the sub-carrier 148; the piston rod 162 is retracted into the motor 164 and is disengaged from and located upwardly of and spaced from the bar 160; a stream of pressurized air is flowing through the ports 174 and 176 of the gap sensor 170; the piston 186 is retracted into the motor 184 so that the spring 190 raises the clamp 182 upwardly of the plate 166; the springs 152 are yieldably urging the sub-carrier 148 forwardly into engagement with the frame 142 as shown in FIG. 12; the piston rod 192 is projected out of the motor 194 to maintain the carrier 144 in a forward position in engagement with the frame 142; the piston rod 244 is retracted into the motor 242 with the lever arm 222 abutting the stud 248 to maintain the gauge 138 in a relatively rearward position and the gauge 168 in a relatively forward position; the piston rod 258 is projected out of the motor 256 to place the base 250 in a forward position; the springs 270 are urging the plate 262 forwardly to a position wherein the lugs 264 abut the mounts 268 and the striker 276 is located forwardly of the lug 278; the piston rod 282 is retracted into the motor 280 and is located above and spaced from the base 250; the piston rod 298 is retracted into the motor 300 to maintain the heel aligner 290 in a forward position; there is no pressurized air entering the port 310 so that the spring 315 maintains the piston 308 in a rearward position to maintain the aligner plate 320 in a rearward position and the aligner pins 326 in outer positions; the piston rods 358 are retracted into the motors 356 to maintain the adhesive applying mechanisms 338 in upper positions; and the piston rods 390 are projecting out of the motors 388 with the bolts 402 abutting the blocks 404.

A roll of "Scotch" Assembly Aid tape 410 manufactured by 3M Company of Saint Paul, Minn. is mounted on each reel 368. From the reel 368, each roll of tape 410, as seen in FIGS. 24 and 28, is extended about one of its associated rolls 380, its associated pad 378, the other of its associated rolls 380, between its associated feed rolls 384, 386 and onto its associated reel 370. The tape 410 is coated on one side with adhesive and is so constituted that when the coated side is brought into contact with an object, adhesive on the tape will adhere to the object.

Figure 30:
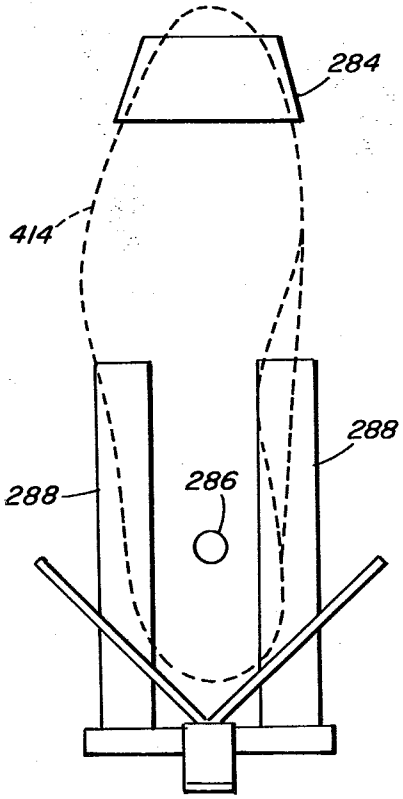
FIG. 30 is a plan view of the last engaging parts of the last support.
Figure 29:
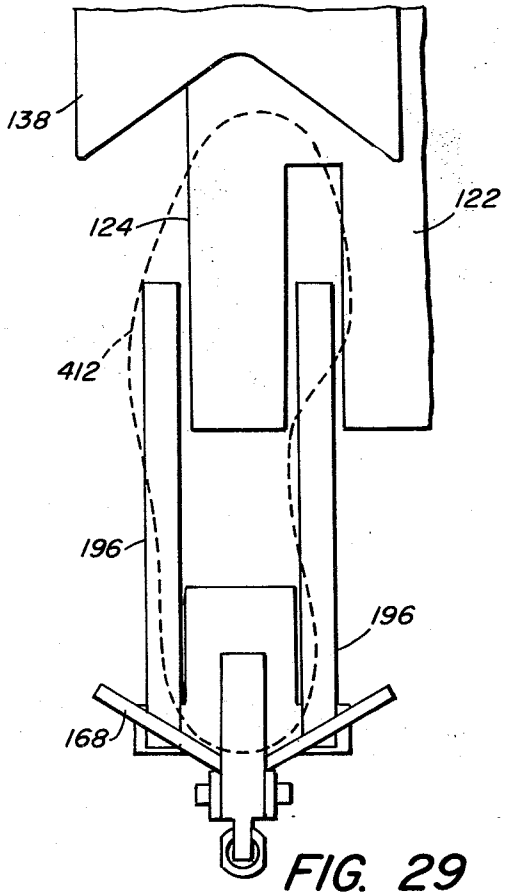
FIG. 29 is a plan view of the insole support as it appears at the beginning of a machine cycle.

As shown in FIG. 29, at the beginning of the machine cycle a flat insole 412 is deposited between the gauges 138 and 168 on the surfaces formed by the fingers 122, 124 and 196. Also, as shown in FIG. 30, at the beginning of the machine cycle a last 414 is so placed bottom-up on the shoe assembly support 283 that the last pin 286 enters the thimble hole in the last 414, the forepart of the last 414 is supported on the toe rest 284 and the bars 288 support the sides of the heel portion of the last 414. The toe ends of the insole 412 and the last 414 face rearwardly towards the molds 14 and 62 and the insole 412 and the bottom of the last 414 are so contoured that the insole will conform in shape to the last bottom after the insole has been molded and applied to the last bottom as described below.

The operator now depresses a pedal (not shown) to shift a cycle starting valve. In response to the shifting of the cycle starting valve, the motor 242 is actuated to yieldably project its piston rod 244 under the resilient force of pressurized air. This projection of the piston rod 244, through the members 222, 216, 218 and 220 (FIG. 9) imparts rearward movement of the frame 142 to thereby cause the frame 142 to move the sub-carrier 148, together with the front gauge block 154, rearwardly with respect to the carrier 144 along the guide bars 150 against the forwardly directed force of the springs 152. This rearward movement of the sub-carrier 148 imparts corresponding rearward movement to the gauge 168 and the fingers 196. The projection of the piston rod 244, through the members 222, 224, 210, 208, 204, 127 and 126 imparts forward movement of the gauge 138 along the platform 118. For reasons that are explained below, the levers 198 and 212 are so pivoted to each other by the pin 234 that the gauge 138 moves forwardly at a faster speed than the gauge 168 moves rearwardly. The rearward movement of the frame 142 imparts rearward movement to the bar 272 and the striker 276 to thereby cause the striker 276 to engage the lug 278 so as to move the lug 278, the plate 262, the last support 283 and the last 414 rearwardly against the forwardly directed forces of the springs 270. The concomitant rearward movement of the gauge 168, forward movement of the gauge 138, and rearward movement of the last support 283 continues until the insoles 412 are centered in between and engaged by the V-shaped gauges 138 and 168 to thereby cause the heel end of the insole 412 to intercept and block the air stream flowing between the ports 174 and 176.

The interception and blockage of the air stream flowing between the ports 174 and 176 by the heel end of an insole 412 causes:

a. actuations of the motor 184 to raise the piston 186 to thereby lower the clamp 182 towards the plate 166 and clamp the heel end of the insole against the plate 166 of the front gauge block 154.

b. an actuation of the motor 164 to project its piston rod 162 against the bar 160 to thereby lock the sub-carrier 148 relative to the carrier 144 in the position assumed by sub-carrier 148 at the time of the interception and blockage of the air stream flowing through the ports 174 and 176 by the heel end of the insole 412;

c. an actuation of the motor 280 to project its piston rod 282 against the base 250 to thereby lock the plate 262, together with the last support 283 and the last 414, in the positions they assumed at the time of the interception and blockage of the air stream flowing through the ports 174 and 176 by the heel end of the insole 412;

d. an actuation of the motor 130 to raise its piston rod 132 to thereby raise the gauge 138 and disengage it from the platform 118 and the toe ends of the insole 412; and e. an actuation of the motor 242 to retract its piston rod 244 to its idle position and thereby return the frame 142 to its forward idle position and return the gauge 138 to its rearward idle position.

The operator can now inspect the insole 412 to determine whether it is properly positioned in the machine. If it is not, he can actuate a release valve (not shown) to return the machine parts to their idle positions, remove the insole and commence the machine cycle anew. If the operator is satisfied with the position of the insole in the machine, he shifts automatic cycling valves 416 (FIGS. 1 and 9) to enable the machine to automatically go through the remainder of its cycle.

In response to the shifting of the valves 416, the motor 114 is actuated to retract its piston rod 116 to thereby lower the platform 118 so that the platform 118 no longer supports the insole 412.

After this, the motor 194 is actuated to retract its piston rod 192 a prescribed distance to thereby move the carrier 144 and the sub-carrier 148 rearwardly a prescribed distance and the motor mounted in the center strut 157 is actuated to project its piston rod 157 rearwardly a prescribed distance to thereby move the front gauge block 154, together with the insole 412 that is now clamped to the front gauge block by the clamp 182 and is now supported on the fingers 196 of the front gauge block, rearwardly a prescribed distance with respect to the sub-carrier 148.

Figure 31:
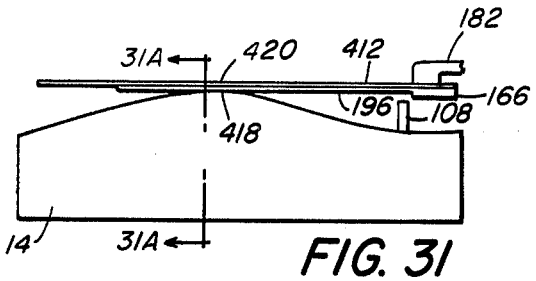
FIG. 31 is a representation of the insole as it appears in relation to the lower mold and the insole support after the insole has been transported between the molds.
Figure 31A:
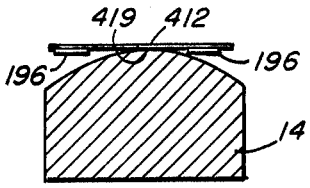
FIG. 31A is a section taken along the line 31A—31A of FIG. 31.

The molds 14 and 62 operate to mold a range of lengths of insoles. As shown in FIG. 31, the lower mold 14 has a ball portion 418 that separates its forepart and shank portions and is at a higher elevation than the remainder of the upper surface of the lower mold 14. The top surface of the lower mold 14 is downwardly concave as shown in FIG. 31A. At the completion of the rearward transporting of the insole 412 described in the preceding paragraph, the fingers 196 are located on the downwardly sloping sides of the ball portion 418 on the opposite sides of the central uppermost portion 419 (FIG. 31A) of the ball portion 418 and the ball portion 420 of the insole is located directly above the ball portion 418 of the lower mold 14 for the proper operation of the below described molding operation. To ensure that the insole ball portion 420 is directly above the lower mold ball portion 418, despite the fact that the insole 412 is transported a prescribed distance rearwardly by the motor 194 and the motor that operates the piston rod 157, regardless of the length of the insole, the levers 198 and 212 are so dimensional and so pivoted to each other by pin 234 that the projection of the piston rod 244 by the motor 242 causes the gauge 138 to move forwardly and the gauge 168 to move rearwardly at such rates that when these gauges have respectively engaged the toe and heel ends of the insoles and the gauge movements are stopped pursuant to the interception and blockage of the air stream flowing between the ports 174 and 176, the insole ball portion 420 is at the location necessary for insole ball portion 420 to be directly above the lower mold ball portion 481. Insoles of different lengths are so constituted that there is a greater change in distances from one insole length to another insole length between the ball portions and the toe ends of the insoles than there is between the ball portions and the heel ends of the insoles. Therefore, the levers 198 and 212 are so dimensioned and are so pivoted to each other by the pin 234 that, in response to the projection of the piston rod 244 by the motor 242, the gauge 138 is caused to move forwardly at a faster rate than the rearward rate of movement imparted to the gauge 168.

Figure 36:
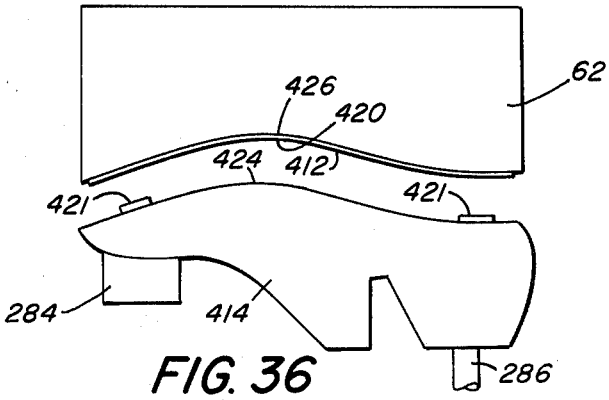
FIG. 36 is a representation of the relationship between the last, the upper mold and the insole just before the insole descends onto the last bottom.

Substantially at the same time as the insole 412 is transported between the molds 14 and 62 as described above, the motors 356 are so actuated as to project their piston rods 358 downwardly under the resilient force of pressurized air and then retract their piston rods 358 back to their idle positions. The projection of the piston rods 358 lowers the plates 360 and the parts carried thereby until the applicator pads 378 engage the forepart and heel seat portions of the bottoms of the last that is mounted on the last holder 283 and transfer patches 421 (FIG. 36) of adhesive from that portion of the tape 410 that is draped about the applicator pads 378 onto the last bottom which patches of adhesive remain coated on the last bottom in tacky condition when the applicator pads 378 are raised from the last bottom pursuant to the upward actuation of the piston rods 358 to their idle positions.

Now the pistons 82 are caused to be lowered in the upper compartments 74 until the pistons 82 engage the tops of the piston rods 80. This causes the upper mold 62 to be lowered to the position shown in FIG. 32 wherein the upper mold is spaced from the lower mold 14 and disengaged from the insole 412. At about the same time, the motors 90 are actuated to project their piston rods 92 downwardly under the yieldable force of pressurized air to cause the piston rods 92 to engage the ball portion 420 of the insole, the piston rods 92 being located above the ball portion 418 of the lower mold 14 and between the fingers 196. Therefore, when the upper mold 62 has reached the FIG. 32 position, the piston rods 92 are holding the insole 412 against the lower mold ball portion 418.

Figure 32:
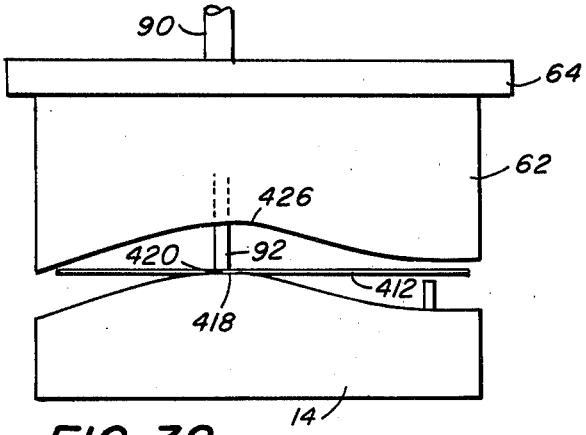
FIG. 32 is a representation of the insole as it appears between the molds prior to the relative closing movement of the molds.

Now the motor 184 is actuated to return the piston 186 to its idle position to thereby enable the spring 190 to raise the clamp 182 and release the insole 412 from the clamp 182. At about the same time, the motor 194 is actuated to return the piston rod 192 to its idle position and the piston rod 156 is retracted into its idle position to thereby return the front gauge block 154, the clamp 182 and the fingers 196 forwardly to their idle positions while the insole 412 is held against the lower mold 14 by the piston rods 92. The spacing of the lower mold 14 and the upper mold 62 at this time, as shown in FIG. 32, provides sufficient clearance to enable the clamp 182, the gauge 168 and the plate 166 to be moved forwardly out from between the molds 14 and 62 without any interference by the molds.

Now the pistons 78 are caused to be lowered to the bottoms of the lower compartments 76 to thereby lower the piston rods 80 in the upper compartments 74 with the pistons 82 continuing to bear against the piston rods 80 during this lowering of the piston rods 80. As a result, the posts 66 are further lowered to lower the block 64 and the upper mold 62 to a position wherein the upper mold 62 is located close to the lower mold 14 but out of contact with the insole 412 supported on the lower mold and held in engagement with the lower mold by the piston rods 92 and the top of the block 64 is below the level of the plates 106. This is followed by actuation of the motors 102 to project their piston rods 104 and thereby move the plates 106 above the block 64.

Now the motor 52 is actuated to project its piston rod 54 to thereby straighten the toggle links 54, 46, 58 from the FIG. 3 position and thus raise the lever 42 about the axis of the pin 40 and raise the lower mold 14 an amount sufficient to cause the insole to be pressed between the complementary top surface of the lower mold 14 and the bottom surface of the upper mold 62 to thereby enable the molds to mold or shape the flat insole 412 to the shape of these complementary surfaces. At about the same time, the motors 90 are actuated to retract the piston rods 92 back to their idle positions, retracted into the upper mold 62.

Figure 33:
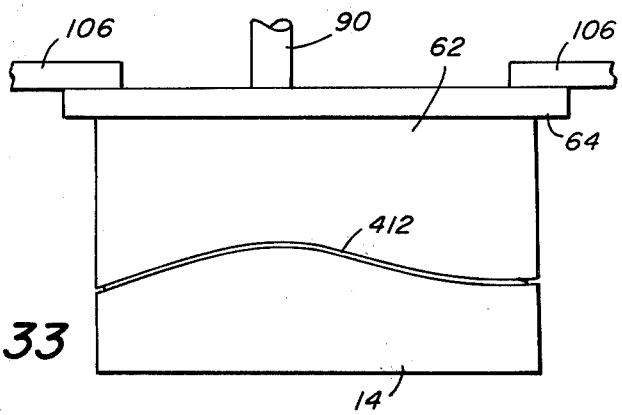
FIG. 33 is a representation of the insole as it appears between the molds while the molding surfaces are molding the insole.

Now the piston rod 30 is projected out of the motor 28 to move the linkage formed by the levers 32, 38 and 42, with the lever 42 swinging clockwise (FIG. 3) about the axis of the pin 44 to move the lower mold upwardly a relatively short distance under heavy molding pressure to complete the molding or shaping of the insole 412 as shown in FIG. 33. The upper mold 62 is urged downwardly into its FIG. 33 position under the yieldable force of pressurized air in the upper compartments 74. The plates 106 lying above the block 64 prevent the upwardly directed molding pressure applied to the lower mold 14 by the motor 28 from moving the upper mold 62 upwardly against the yieldable downward force of the pressurized air in the upper compartments 74.

During the pressing and molding of the insole 412 between the lower mold 14 and the upper mold 62, pursuant to the actuations of the motors 52 and 28, the springs 20 enable the lower mold to shift relative to the base 18 to ensure that uniform molding pressure is applied against the insole by the molds despite any differences in any thicknesses of different parts of the insole and despite any variances in the complementary nature of the top surface of the lower mold and the bottom surface of the upper mold.

Figure 34:
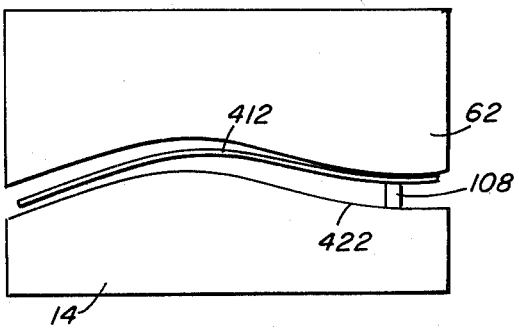
FIG. 34 is a representation of the insole as it appears between the molds when the molds are apart just after the molding operation.

After the lapse of a predetermined time interval, the motors 28 and 52 are actuated to retract their respective piston rods 30 and 54 to thereby lower the lower mold 14 to its idle position wherein it is spaced from the upper mold 62. The pins 108, which are located in the front heel seat portion 422 (FIG. 34) of the lower mold 14, had been depressed into the lower mold during the molding operation shown in FIG. 33. The raising of the upper mold 62 enables the pins 108 to be projected upwardly of the lower mold heel seat portion 422 to thereby raise the heel portion of the molded insole 412 and thus create a space between the heel portion of the molded insole 412 and the lower mold heel seat portion 422 to thus enable the molded insole 412 to be readily removed from the lower mold 14.

Figure 35:
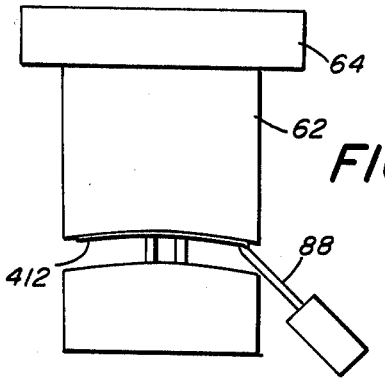
FIG. 35 is a representation of the insole being retained on the upper mold molding surface during the rise of the upper mold subsequent to the molding operation.

Now the motor 84 is actuated under the yieldable force of pressurized air to project its plunger 88 into the space between the heel portion of the molded insole 412 and the lower mold heel seat portion 422 and press the molded insole against the bottom of the upper mold 62 as shown in FIG. 35. At about the same time, the motors 102 are actuated to retract their piston rods 104 to thereby withdraw the plates 106 from above the block 64.

After this, the pistons 82 in the upper compartments 74 and the pistons 78 in the lower compartments 76 are raised to their idle positions to thereby raise the upper mold 62 to its idle position. The plunger 88 continues to press the molded insole 412 against the bottom of the upper mold during this rise of the upper mold. In its raised position, the molded insole 412 that is pressed against the bottom of the upper mold 62 is at a higher elevation than the bottom of the last 414 that is mounted on the last support 283.

Now the motor 256 is actuated to retract its piston rod 258 a prescribed amount to thereby move the base 250, the plate 256 and the last support 283 rearwardly a prescribed distance so as to place the last 414 bottom-up a short distance below the upper mold 62. The aforementioned rearward movement of the plate 262 and the last 414 relative to the base 250, caused by the engagement of the lug 278 by the striker 276, is such that at the end of the rearward movement of the last support by the motor 256 the ball portion 424 of the last bottom is in approximate vertical registry with the ball portion 426 of the upper mold 62 and the ball portion 420 of the insole 412 (see FIG. 36). This is followed by actuation of the motor 84 to retract the plunger 88 to its idle position out from under the insole 412 to thereby enable the molded insole 412 to fall by gravity onto the bottom of the last 414 with the ball portion 420 of the insole 412 in approximate registry with the ball portion 424 of the bottom of the last 414. After this, the motor 256 is actuated to project its piston rod 258 to thereby move the last support 283 and the last 414 forwardly to bring the last back to the position it had been in beneath the applicator pads 378 when the adhesive patches 421 were applied to the last bottom.

Now the motor 300 is actuated to project its piston rod 298 to thereby force the heel aligner 290 into engagement with the heel end of the last 414. At about the same time, pressurized air is caused to enter the post 310 to move the piston 308 forwardly and thus, through the linkage shown in FIGS. 20–22, move the aligner plate 320 forwardly into engagement with the toe end of the last 414 and move the aligner pins 326 inwardly into engagement with the sides of the forepart of the last 414. These engagements of the members 290, 320 and 326 with the last shift the insole 412, if it was not in exact registry with the last bottom when it had descended onto the last bottom from the upper mold 62, into exact registry with the last bottom.

Figure 37:
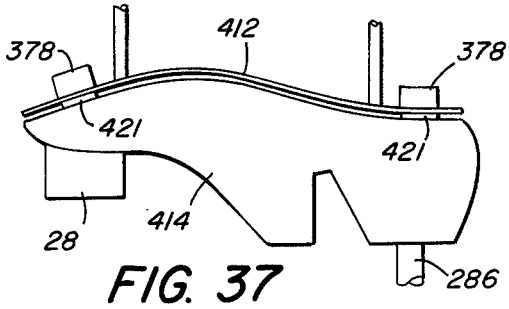
FIG. 37 shows the relationship between the last, the applicator and the insole as the applicator is pressing the insole against the last bottom.

Referring to FIG. 37, after this, the motors 356 are again so actuated as to project their piston rods 358 downwardly to cause the applicator pads 378 to engage the insole 412 above the adhesive patches 421 that were previously applied to the last bottom, and to then raise the applicator pads 378. At this time, there is no adhesive on these portions of the tape 410 that are draped about the applicator pads 378 since the adhesive on these portions of the tape has previously been transferred to the last bottom in the form of the patches 421. The pressure now applied by the pads 378 functions to press the insole 412 against the bottom of the last 414 and cause the insole 412 to adhere to the last bottom by means of the patches 412. During the descent of the applicator pads 378 and before they engage the insole 412, the hold-down bars 408 are resiliently pressed against the insole alongside of the pads 378 and remain pressed against the insole until after the pads 378 have commenced their rise away from the insole. The hold-down bars 408 thus function to prevent shifting of the insole on the last bottom during the engagement of the pads 378 with the last bottom.

Now the motor 300 is actuated to return the heel aligner 290 to its idle position disengaged from the last 414 and the pressurized air is vented from the port 310 to enable the aligner plate 320 and the aligner pins 326 ro return to their idle positions disengaged from the last 414.

The motors 388 are now actuated to first move their piston rods 390 upwardly and then downwardly. This enables the one-way clutches 400 to so rotate the feed rolls 384 and 386 as to feed a new increment of the tape 410 beneath the pads 378, this feeding causing the tape to be unwound from the reels 368 and rewound onto the reel 370. The rotation of the reels 368, pursuant to the unwinding of the tape 410 therefrom enables the chains 376 to effect such rotation of the reels 370 as to effect rewinding of the tape 410 thereon. As a result, new portions of the tape 410 having adhesive thereon are draped about the pads 378 in readiness to be applied to the bottom of a last in the next machine cycle.

This completes the machine cycle. The operator now removes the last 414, having the insole 412 adhered to its bottom by the patches 421, from the machine.

There follows a description of those portions of the machine and its mode of operation that are germane to this invention.

The machine comprises: the lower mold 14; the upper mold 62, located above the lower mold 14, mounted for heightwise movement between an elevated position spaced from the lower mold 14 and a lower position proximate to the lower mold; complementary molding surfaces on the top surface of the lower mold and the bottom surface of the upper mold; means formed by the pressurized air directed into the compartments 74 and 76 and by the motors 28 and 52 for initially maintaining the molding surfaces spaced from each other while the flat insole 412 is transported between the molding surfaces; means formed by the pressurized air directed into the compartments 74 and 76 and the motors 28 and 52 for thereafter effecting relative closing movement between the molding surfaces to mold the flat insole 412 to the shape of the molding surfaces; means formed by pressurized air so entering the compartments 74 as to raise the posts 66 for thereafter raising the upper mold 62 to its elevated position; means formed by the plunger 88 for retaining the molded insole 412 on the upper mold molding surface during the rise of the upper mold; means that include the motor 256 for thereafter placing the last 414 supported bottom-up between the molds; means formed by the motors 84 retracting the plunger 88 for thereafter releasing the molded insole 412 to permit the molded insole to descend onto the last bottom; and means, formed by the applicators 378, for thereafter attaching the molded insole 412 to the last bottom.

The means for placing the last 414 between the molds 14 and 62 comprises: the last support 283 mounted for movement between a forward position located forwardly of the molds and a rearward insole receiving position between the molds; means comprised of the motor 256 for initially retaining the last support 283 in its forward position; and means comprised of the motor 256, operative after the rise of the upper mold 62 to its elevated position, for moving the last support 283 rearwardly to its rearward position.

The molding surfaces of the lower mold and the upper mold respectively have ball portions 418 and 426 at a higher elevation than the remainders of the molding surfaces. The insole 412 is so transported between the molding surfaces as to automatically locate the insole ball portion 420 in substantial heightwise registry with the molding surface ball portions by insole transporting means that comprises: an insole support formed by the plate 166 and the fingers 196 mounted for movement between a forward insole loading position located forwardly of the molds 14, 62 and a rearward position located between the molds; means, comprised of the motor 194, for initially maintaining the insole support 166, 196 in its forward position; means, comprised of the motor 194, operable to move the insole support 166, 196 rearwardly a prescribed distance to its rearward position; insole positioning means, comprised of the gauges 138 and 168, cooperative with the insole 412 to so shift the insole in forward-rearward directions on the insole support 166, 196 that, regardless of the length of the insole 412, the ball portion 420 is in substantial heightwise registration with the ball portions 418, 426 of the molding surfaces after the insole support 166, 196 has moved rearwardly said prescribed distance; means, comprised of the motor 194, for thereafter moving the insole support 166, 196 forwardly to its forward position; and restraining means, comprised of the rods 92, for retaining the insole 412 between the molding surfaces during the forward movement of the support 166, 196.

The means for placing the last 414 between the molds 14 and 62 comprises: the base 250 mounted for forward-rearward movement; the last support 283 mounted to the base 250 for forward-rearward adjustment; means, comprised of the motor 256, for initially maintaining the base 250 in a forward position; means, comprised of the motor 256, operable to move the base 250 a prescribed distance to a rearward position; and last positioning means, comprised of the striker 276 and the lug 278, cooperative with the insole positioning means 138, 168 to so position the last support 283 in forward-rearward directions on the base 250 that, regardless of the length of the last 414, the ball portion 424 of the last bottom is in substantial heightwise registration with the ball portion 426 of the upper mold molding surface after the base 250 has been moved rearwardly through its prescribed distance.

The insole transporting means comprises: the carrier 144 mounted for forward-rearward movement through a prescribed distance; the sub-carrier 148 mounted to the carrier 144 for forward-rearward movement; the gauge block 154, which is a front gauge block, to which the insole support 166, 196 is connected, mounted to the sub-carrier 148; the rearwardly facing front gauge 168 on the front gauge block 154; the clamp 182 mounted to the front gauge block 154 for movement between an open position spaced from the insole support 166, 196 and a clamping position wherein it may clamp the insole 412 to the insole support 166, 196: the gauge 138, which is a forwardly facing back gauge, located rearwardly of the front gauge 168, mounted for heightwise movement and for forward-rearward movement; means, comprised of the motor 194, for initially locating the carrier 144 in a forward position; means, comprised of the springs 152, for initially locating the sub-carrier 148 in a forward position relative to the carrier 144; means, comprised of the spring 190, for initially locating the clamp 182 in its open position; means, comprised of the motor 130, for initially locating the back gauge 138 in a lower position in prone and forward-rearward registry with the front gauge 168; means, comprised of the motor 242, for initially locating the back gauge 138 in a rearward position; gauge moving means, comprised of the motor 242, for concimitantly moving the sub-carrier 148, together with the front gauge 168, rearwardly with respect to the carrier 144 and the back gauge 138 forwardly to thereby shift the insole 412 which is on the insole support 166, 196 between the gauges until the ends of the insole are engaged by both gauges; means, comprised of the air stream flowing through the ports 174 and 176, operative after the engagement of the insole 412 by both gauges, to terminate the concomitant forward back gauge movement and the rearward front gauge movement, to lock, by actuation of the motor 163, the sub-carrier 148 to the carrier 144, to raise, by actuation of the motor 130, the back gauge 138 out of registry with the front gauge 168, and to move, by actuation of the motor 186, the clamp 182 into its clamping position; and means, comprised of the motor 194, to thereafter move the carrier 144, together with the insole support 166, 196, rearwardly through said prescribed distance.

The front gauge block 154 is mounted to the sub-carrier 148. The pneumatic motor mounted in the center strut 157 of the sub-carrier 148 and the piston rod 156 of this motor act as means for initially locating the front gauge block 154 in a forward position relative to the sub-carrier 148 and means operative to move the front gauge block 154, together with the insole support 166, 196, rearwardly a prescribed distance relative to the sub-carrier 148 at about the same time as the carrier 144 is moved rearwardly.

The insole 412 is so supported on the insole support 166, 196 that its toe end faces rearwardly. The molding surfaces toe ends face rearwardly. The gauge moving means, comprised of the motor 242 and the linkage between the motor 242 and the gauges 138 and 168, is so constructed as to move the back gauge 138 forwardly at a faster rate than it moves the front gauge 168 rearwardly.

At least one rod 92 is located in the ball portion 426 of the upper mold 62 and mounted for movement between a concealed position wherein the rod 92 is retracted into the upper mold and a projecting position where the rod 92 projects downwardly of the upper mold 62 towards the ball portion 418 of the lower mold molding surface. The motor 90 associated with each rod 92 acts as means for initially locating the rod 92 in its concealed position. The admission of pressurized air to the upper compartments 74 to move the pistons 82 downwardly and the motor 90 respectively acts as means, effective when the insole support has completed its rearward movement to place the insole 412 between the molds 14 and 62, to locate the upper mold 62 in an intermediate position between its elevated and lower positions and to urge the rod 92 into its projecting position to thereby press the insole 412 against the ball portion 418 of the lower mold molding surface. The motor 184 and the spring 190 act as means for thereafter returning the clamp 182 to its open position. The motor 194 acts as means, effective after the pressing of the insole 412 against the ball portion 418 of the lower mold molding surface by the rod 92, for moving the carrier 144, together with the insole support 166, 196, back to its forward position. The motor 90 acts as means for thereafter, and prior to effecting the relative closing movement of the molds 14 and 62, returning the rod 92 to its concealed position.

The lower mold 14 is mounted for upward movement from a lower position. The upper mold 62 is in an intermediate position between its elevated and lower positions with its molding surface spaced from the molding surface of the lower mold 14 which is in its lower position after the insole 412 has been transported between the molding surfaces. The means for effecting relative closing movement between the molding surfaces to mold the insole 412 comprises: means, comprised of the admission of pressurized air to the lower compartments 76 to lower the pistons 78, for lowering the upper mold 62 to its lower position; means, comprised of the motor 82 and the linkage connecting this motor to the lower mold 14, for thereafter raising the lower mold a relatively great distance under relatively low pressure, this relatively great distance being an amount sufficient to press the insole 412 between the complementary molding surfaces and thus commence to mold the insole; and means, comprised of the motor 28 and the linkage connecting this motor to the lower mold 14, for thereafter imparting relatively high upwardly directed pressure to the lower mold 14 while raising the lower mold a relatively short distance to complete the molding of the insole 412.

The lower mold 14 is mounted on the base 18, by the springs 20 and the studs 22, for limited universal rocking movement to enable the lower mold 14 to shift relative to the base 18 during the application of the relatively high pressure by the lower mold 14 to the insole 412.

Each plate 106 is located alongside the path of heightwise movement of the upper mold 62 and is mounted for movement over the top of the upper mold 62 when the upper mold is in its lower position to thereby resist upward displacement of the upper mold 62 during the application of the relatively high upwardly directed pressure by the lower mold 14 to the insole 412.

The motors 28 and 52 act as means, effective after the relative closing movement of the molds 14 and 62 and prior to the raising of the upper mold 62 to its elevated position, to impart relative opening movement to the molds. The pins 108 act as a lifting mechanism operative to lift at least a part of the molded insole upwardly of the lower mold molding surface when pressure is removed from the lower mold molding surface pursuant to the relative opening movement of the molds. The means for retaining the molded insole 412 on the upper mold molding surface and the means for releasing the molded insole 412 from the upper mold molding surface comprises: at least one of the plungers 88 mounted to the upper mold 62 for heightwise movement therewith and mounted for movement between an idle position wherein the plunger 88 is located outwardly of the space between the complementary molding surfaces and a working position wherein the plunger 88 is urged towards the upper mold molding surface to effect the retaining of the molded insole; means, comprised of the motor 84, for initially retaining the plunger 88 in its idle position; means, comprised of the motor 84, operative after the lifting mechanism 108 has lifted at least a part of the molded insole 412 upwardly of the lower mold molding surface, to move the plunger 88 to its working position; and means, comprised of the motor 84, operative after the upper mold 62 is in its elevated position and the last 414 has been placed between the molds 14 and 62, to return the plunger 88 to its idle position to thereby effect the releasing of the molded insole 412.

The lifting mechanism comprises at least one pin 108 in the lower mold 14 so mounted as to be yieldably urged upwardly of the lower mold molding surface and to be depressible into the lower mold pursuant to the application of pressure against the pin.

At least one applicator 378 is located above the last 414 when the last support 283 is in its forward position. The applicator 378 is mounted for yieldable movement downwardly of an upper position wherein the applicator is spaced from the last bottom. The applicator has a segment of adhesive located thereon that is so constituted as to be separated from the applicator 378 and adhere to an object when the applicator is pressed against the object. Means, comprised of the motor 356, initially retain the applicator 378 in its upper position. Means, comprised of the motor 356, operative when the lastsupport 283 is in its initial forward position, so reciprocate the applicator as to cause the applicator to move downwardly and press the adhesive segment against the last bottom and then move upwardly to its upper position, the pressing of the adhesive segment against the last bottom causing the adhesive segment to adhere to the last bottom in the form of the patch 421. Means, comprised of the motor 256, operative when the molded insole 412 has descended onto the last bottom, move the last support 283 forwardly to return the last support back to its forward position. The means for attaching the molded insole 412 to the last bottom comprises: means, comprised of the motor 356, operative when the last support 283 has been returned back to its forward position, to so reciprocate the applicator 378 as to cause the applicator to move downwardly and press the insole 412 against the last bottom and thereby enable the insole to adhere to the last bottom by way of the adhesive segment or patch 421 and then move upwardly to its idle position.

Means, comprised of the feed rolls 384 and 386, present a new segment of adhesive to the applicator 378 after the second mentioned return of the applicator to its upper position, as referred to in the preceding paragraph.

The tape segment is a part of a strip of the tape 410 extending about the applicator 378, the tape 410 having adhesive coated on its downwardly facing side that is to constituted as to be separated from the tape when the coated side of the tape is pressed against an object.

Means, comprised of the feed rolls 384 and 386, are operative, after the above referred to second mentioned return of the applicator 378 to its upper position, to so feed the tape strip past the applicator as to provide a new segment of tape extending about the applicator.

I claim:

1. A machine molding an insole and attaching the molded insole to a last bottom comprising: a lower mold; an upper mold, located above the lower mold, mounted for heightwise movement between an elevated position spaced from the lower mold and a lower position proximate to the lower mold; complementary molding surfaces on the top surface of the lower mold and the bottom surface of the upper mold; means for initially maintaining the molding surfaces spaced from each other while a flat insole is transported between the molding surfaces; means for thereafter effecting relative closing movement between the molding surfaces to mold the flat insole to the shape of the molding surfaces; means for thereafter raising the upper mold to its elevated position; means for retaining the molded insole on the upper mold molding surface during the rise of the upper mold; means for thereafter placing a last supported bottom-up between the molds; means for thereafter releasing the molded insole from the upper mold molding surface to permit the molded insole to descend onto the last bottom; and means for thereafter attaching the molded insole to the last bottom.

2. The machine according to claim 1 wherein the means for placing the last between the molds comprises: a last support mounted for movement between a forward position located forwardly of the molds and a rearward insole receiving position between the molds when the upper mold is in its elevated position; means for initially retaining the last support in its forward position; and means, operative after the rise of the upper mold to its elevated position, for moving the last support rearwardly to its rearward position.

3. The machine according to claim 1 wherein the lower and the upper molding surfaces each has a ball portion at a higher elevation than the remainder of its molding surface and wherein the insole is so transported between the molding surfaces as to automatically locate the insole ball portion in substantial heightwise registry with the molding surface ball portions by insole transporting means that comprises: an insole support mounted for forward-rearward movement between a forward insole loading position located forwardly of the molds and a rearward position located between the molds; means for initially maintaining the insole support in its forward position; means operable to move the insole support rearwardly a prescribed distance to its rearward position; insole positioning means cooperative with the insole to so shift the insole in forward-rearward directions on the insole support that, regardless of the length of the insole, the ball portion of the insole is in substantial heightwise registration with the ball portions of the molding surfaces after the insole support has moved rearwardly said prescribed distance; means for thereafter moving the insole support forwardly to its forward position; and restraining means for retaining the insole between the molding surfaces during the forward movement of the insole support.

4. The machine according to claim 3 wherein the means for placing the last between the molds comprises: a base mounted for forward-rearward movement; a last support mounted to the base for forward-rearward adjustment; means for initially maintaining the base in a forward position; means operable to move the base rearwardly a prescribed distance to a rearward position; and last positioning means cooperative with the insole positioning means to so adjust the position of the last support in forward-rearward directions on the base so that, regardless of the length of the last, the ball portion of the last bottom is in substantial heightwise registration with the ball portion of the upper mold molding surface after the base has been moved rearwardly through its prescribed distance.

5. The machine according to claim 3 wherein the insole transporting means comprises: a carrier mounted for forward-rearward movement through a prescribed distance; a sub-carrier mounted to the carrier for forward-rearward movement; a front gauge block, to which the insole support is connected, mounted to the sub-carrier; a rearwardly facing front gauge on the front gauge block; a clamp mounted to the front gauge block for movement between an open position spaced from the insole support and a clamping position wherein it may clamp the insole to the insole support; a forwardly facing back gauge, located rearwardly of the front gauge, mounted for heightwise movement and for forward-rearward movement; means for initially locating the carrier in a forward position; means for initially locating the sub-carrier in a forward position relative to the carrier; means for initially locating the clamp in its open position; means for initially locating the back gauge in a lower position in prone and forward-rearward registry with the front gauge and in a rearward position; gauge moving means for concomitantly moving the sub-carrier, together with the front gauge, rearwardly with respect to the carrier and the back gauge forwardly to thereby shift the insole which is on the insole support between the gauges until the ends of the insole are engaged by both gauges; means, operative after the engagement of the insole ends by both gauges to terminate the concomitant forward back gauge movement and the rearward front gauge movement, to lock the sub-carrier to the carrier, to raise the back gauge out of said registry with the front gauge, and to move the clamp into its clamping position; and means to thereafter move the carrier, together with the insole support, rearwardly through said prescribed distance.

6. The machine according to claim 5 further comprising: means mounting the front gauge block to the sub-carrier for forward-rearward movement; means for initially locating the front gauge block in a forward position relative to the sub-carrier; and means operative to move the front gauge block, together with the insole support, rearwardly a prescribed distance relative to the sub-carrier at about the same time as the carrier is moved rearwardly.

7. The machine according to claim 5 wherein the insole is so supported on the insole support that its toe end faces rearwardly; wherein the molding surfaces toe ends face rearwardly; and wherein the gauge moving means is so constructed as to move the back gauge forwardly at a faster rate than it moves the front gauge rearwardly.

8. The machine according to claim 5, claim 6 or claim 7 wherein the means for placing the last between the molds comprises: a base mounted for forward-rearward movement; a last support mounted to the base for forward-rearward adjustment; means for initially maintaining the base in a forward position; means for initially maintaining the last support in a forward position relative to the base; adjusting means so relating the carrier to the last support as to adjust the last support rearwardly relative to the base pursuant to the rearward movement of the sub-carrier relative to the carrier; means operative after the termination of the rearward movement of the sub-carrier and the front gauge with respect to the carrier to lock the last support to the base; and means for thereafter moving the base rearwardly through a prescribed distance.

9. The machine according to claim 5, claim 6 or claim 7 further comprising: at least one rod in the ball portion of the upper mold mounted for movement between a concealed position wherein the rod is retracted into the upper mold and a projecting position wherein the rod projects downwardly of the upper mold towards the ball portion of the lower mold molding surfaces; means for initially locating the rod in its concealed position; means, effective when the insole support has completed its rearward movement, to place the insole between the molds, to locate the upper mold in an intermediate position between its elevated and lower positions, and to urge the rod into its projecting position to thereby press the insole against the ball portion of the lower mold molding surface; means for thereafter returning the clamp to its open position and for moving the carrier, together with the insole support, back to its forward position; and means for thereafter, and prior to effecting said relative closing movement between the molds, returning the rod to its concealed position.

10. The machine according to claim 8 further comprising: at least one rod in the ball portion of the upper mold mounted for movement between a concealed position wherein the rod is retracted into the upper mold and a projecting position wherein the rod projects downwardly of the upper mold towards the ball portion of the lower mold molding surface; means for initially locating the rod in its concealed position; means, effective when the insole support has completed its rearward movement, to place the insole between the molds, to locate the upper mold in an intermediate position between its elevated and lower positions and to urge the rod into its projecting position to thereby press the insole against the ball portion of the lower mold molding surface; means for thereafter returning the clamp to its open position and for moving the carrier, together with the insole support, back to its forward position; and means for thereafter and prior to effecting said relative closing movement between the molds, returning the rod to its concealed position.

11. The machine according to claim 1 wherein the lower mold is mounted for upward movement from a lower position; wherein the upper mold is in an intermediate between its elevated and lower positions with its molding surface spaced from the molding surface of the lower mold which is in its lower position after the insole has been transported between the molding surfaces; and wherein the means for effecting relative closing movement between the molding surfaces to mold the insole comprises: means for lowering the upper mold from its intermediate position to its lower position; means for thereafter raising the lower mold a relatively great distance under relatively light pressure, said relative great distance being an amount sufficient to press the insole between the complementary molding surfaces and thus commence to mold the insole; and means for thereafter imparting relatively high upwardly directed pressure to the lower mold while raising the lower mold a relatively short distance to complete the molding of the insole.

12. The machine according to claim 11 wherein the lower mold is mounted on a base for limited universal rocking movement to enable the lower mold to shift relative to the base during the application of said relatively high pressure by the lower mold to the insole.

13. The machine according to claim 11 or claim 12 comprising a plate located alongside the path of heightwise movement of the upper mold and mounted for movement over the top of the upper mold when the upper mold is in its lower position to thereby resist upward displacement of the upper mold during the application of the relatively high upwardly directed pressure by the lower mold to the insole.

14. The machine according to claim 1 further comprising: means, effective after said relative closing movement of the molds and prior to said raising of the upper mold to its elevated position, to impart relative opening movement to the molds; and a lifting mechanism operative to lift at least a part of the molded insole upwardly of the lower mold molding surface when pressure is removed from the lower mold molding surface pursuant to said relative opening movement of the molds; and wherein said means for retaining the molded insole on the upper mold molding surface and said means for releasing the molded insole from the upper mold molding surface comprises: at least one plunger mounted to the upper mold for heightwise movement therewith and mounted for movement between an idle position wherein the plunger is located outwardly of the space between the complementary molding surfaces and a working position wherein the plunger is urged towards the upper mold molding surface to effect the retaining of the molded insole; means for initially retaining the plunger in its idle position; means, operative after the lifting mechanism has lifted at least a part of the molded insole upwardly of the lower mold molding surface, to move the plunger to its working position; and means, operative after the upper mold is in its elevated position and the last has been placed between the molds, to return the plunger to its idle position to thereby effect said releasing of the molded insole.

15. The machine according to claim 14 wherein the lifting mechanism comprises: at least one pin in the lower mold so mounted as to be yieldably urged upwardly of the lower mold molding surface and to be depressible into the lower mold pursuant to the application of pressure against the pin.

16. The machine according to claim 2 further comprising: at least one applicator, located above the last when the last support is in its forward position, mounted for yieldable movement downwardly of an upper position wherein the applicator is spaced from the last bottom, the applicator having a segment of adhesive located thereon that is so constituted as to be separated from the applicator and adhere to an object when the applicator is pressed against the object; means for initially retaining the applicator in its upper position; means, operative when the last support is in its initial forward position, to reciprocate the applicator so as to cause the applicator to move downwardly and press the adhesive segment against the last bottom and then move upwardly to its upper position, the pressing of the adhesive segment against the last bottom causing the adhesive segment to adhere to the last bottom; and means, operative when the molded insole has descended onto the last bottom, for moving the last support forwardly to return the last support back to its forward position; and wherein the means for attaching the molded insole to the last bottom comprises: means, operative when the last support has been returned back to its forward position, to reciprocate the applicator so as to cause the applicator to move downwardly and press the insole against the last bottom and thereby enable the insole to adhere to the last bottom by way of the adhesive segment and then move upwardly to its upper position.

17. The machine according to claim 16 further comprising: means to present a new segment of adhesive to the applicator after the second mentioned return of the applicator to its upper position.

18. The machine according to claim 16 wherein the tape segment is a part of a strip of tape extending about the applicator, the tape having adhesive coated on its downwardly facing side that is so constituted as to be separated from the tape when the coated side of the tape is pressed against an object.

19. The machine according to claim 18 further comprising: means, operative after the second mentioned return of the applicator to its upper position, to so feed the tape strip past the applicator as to provide a new segment of tape extending about the applicator.

20. A machine for molding an insole comprising: a lower mold, an upper mold located above the lower mold; complementary molding surfaces on the top surface of the lower mold and the bottom surface of the upper mold; a ball portion on each of the molding surfaces having a higher elevation than the remainder of the molding surfaces; means for initially maintaining the molding surfaces spaced from each other; an insole support mounted for forward-rearward movement between a forward insole loading position located forwardly of the molds and a rearward position located between the molds; means for initially maintaining the insole support in its forward position; means operable to move the insole support rearwardly a prescribed distance to its rearward position; insole positioning means cooperative with the insole to so shift the insole in forward-rearward directions on the insole support that, regardless of the length of the insole, the ball portion of the insole is in substantial heightwise registration with the ball portions of the molding surfaces after the insole support has moved rearwardly said prescribed distance; means for thereafter moving the insole support forwardly to its forward position; restraining means for retaining the insole between the molding surfaces during the forward movement of the insole support; and means for thereafter effecting relative closing movement between the molding surfaces to mold the flat insole to the shape of the molding surfaces.

21. The machine according to claim 20 wherein the insole support, the insole positioning means, and the means to move the insole support rearwardly comprise: a carrier mounted for forward-rearward movement through a prescribed distance; a sub-carrier mounted to the carrier for forward-rearward movement; a front gauge block, to which the insole support is connected, mounted to the sub-carrier; a rearwardly facing front gauge on the front gauge block; a clamp mounted to the front gauge block for movement between an open position spaced from the insole support and a clamping position wherein it may clamp the insole to the insole support; a forwardly facing back gauge, located rearwardly of the front gauge, mounted for heightwise movement and for forward-rearward movement; means for initially locating the carrier in a forward position; means for initially locating the sub-carrier in a forward position relative to the carrier; means for initially locating the clamp in its open position; means for initially locating the back gauge in a lower position in prone and forward-rearward registry with the front gauge and in a rearward position; gauge moving means for concomitantly moving the sub-carrier, together with the front gauge, rearwardly, with respect to the carrier and the back gauge forwardly to thereby shift the insole which is on the insole support between the gauges until the ends of the insole are engaged by both gauges; means operative after the engagement of the insole ends by both gauges to terminate the concomitant forward back gauge movement and the rearward front gauge movement, to lock the subcarrier to the carrier, to raise the back gauge out of said registry with the front gauge, and to move the clamp into its clamping position; and means to thereafter move the carrier, together with the insole support rearwardly through said prescribed distance.

22. The machine according to claim 21 further comprising: means mounting the front gauge block to the sub-carrier for forward-rearward movement; means for initially locating the front gauge block in a forward position relative to the sub-carrier; and means operative to move the gauge block, together with the insole support, rearwardly a prescribed distance relative to the sub-carrier at about the same time as the carrier is moved rearwardly.

23. The machine according to claim 21 wherein the insole is so supported on the insole support that its toe end faces rearwardly; wherein the molding surfaces toe ends face rearwardly; and wherein the gauge moving means are so constructed as to move the back gauge forwardly at a faster rate than it moves the front gauge rearwardly.

24. The machine according to claim 21, claim 22, or claim 23 further comprising: at least one rod in the ball portion of the upper mold mounted for movement between a concealed position wherein the rod is retracted into the upper mold and a projecting position wherein the rod projects downwardly of the upper mold towards the ball portion of the lower mold molding surface; means for initially locating the rod in its concealed position; means, effective when the insole support has completed its rearward movement to place the insole between the molds and to urge the rod into its projecting position to thereby press the insole against the ball portion of the lower mold molding surface; means for thereafter returning the clamp to its open position and for moving the carrier, together with the insole support, back to its forward position; and means for thereafter, and prior to effecting said relative closing movement between the molds, returning the rod to its concealed position.

25. A machine for molding an insole comprising: a lower mold mounted for upward movement from a lower position; an upper mold located above the lower mold; complementary molding surfaces on the top surface of the lower mold and the bottom surface of the upper mold; means for initially locating the lower mold in its lower position so that the molding surfaces are spaced from each other with a flat insole located between the molding surfaces; means for thereafter raising the lower mold a relatively great distance under relatively light pressure, said relatively great distance being an amount sufficient to press the insole between the complementary molding surfaces and thus commence to mold the insole; and means for thereafter imparting relatively high upwardly directed pressure to the lower mold while raising the lower mold a relatively short distance to complete the molding of the insole.

26. The machine according to claim 25 wherein the lower mold is mounted on a base for limited universal rocking movement to enable the lower mold to shift relative to the base during the application of said relatively high pressure by the lower mold.

27. The machine according to claim 25 or claim 26 wherein the upper mold is mounted for heightwise movement and is in a lower position when the aforesaid pressures are imparted to the lower mold and further comprising a plate located alongside the path of heightwise movement of the upper mold and mounted for movement over the top of the upper mold when the upper mold is in its lower position to thereby resist upward displacement of the upper mold during the application of the relatively high upwardly directed pressure by the lower mold.

28. A machine for attaching a molded insole to a last bottom comprising: a last support supporting a last that is bottom-up; at least one applicator, located above the last, mounted for yieldable movement downwardly of an upper position wherein the applicator is spaced from the last bottom, the applicator having a segment of adhesive located thereon that is so constituted as to be separated from the applicator and adhere to an object when the applicator is pressed against the object; means for initially retaining the applicator in its upper position; means operative to thereafter reciprocate the applicator so as to cause the applicator to move downwardly and press the adhesive segment against the last bottom and then move upwardly to its upper position, the pressing of the adhesive segment against the last bottom causing the adhesive segment to adhere to the last bottom; means thereafter enablng a molded insole to be placed on the last bottom; and means thereafter operative to reciprocate the applicator so as to cause the applicator to move downwardly and press the insole against the last bottom to thereby enable the insole to adhere to the last bottom by way of the adhesive segment and then move upwardly to its upper position.

29. The machine according to claim 28 further comprising: means to present a new segment of adhesive to the applicator after the second mentioned return of the applicator to its upper position.

30. The machine according to claim 28 wherein the tape segment is a part of a strip of tape extending about the applicator, the tape having adhesive coated on its downwardly facing side that is so constituted as to be separated from the tape when the coated side of the tape is pressed against an object.

31. The machine according to claim 30 further comprising: means, operative after the second mentioned return of the applicator to its upper position, to so feed the tape strip past the applicator as to provide a new segment of tape extending about the applicator.

32. A method of molding an insole and attaching the molded insole to a last bottom comprising: providing a lower mold and an upper mold that is located above the lower mold, the molds having complementary molding surfaces on the top surface of the lower mold and the bottom surface of the upper mold; initially maintaining the molding surfaces spaced from each other while a flat insole is transported between the molding surfaces; thereafter effecting relative closing movement between the molding surfaces to mold the flat insole to the shape of the molding surfaces; thereafter raising the upper mold to an elevated position while retaining the molded insole on the upper mold molding surface; thereafter placing a last supported bottom-up between the molds; thereafter releasing the molded insole from the upper mold molding surface to permit the molded insole to descend onto the last bottom; and thereafter attaching the molded insole to the last bottom.

33. The method according to claim 32 wherein the last is supported on a last support that is initially retained in a forward position located forwardly of the molds and is moved to a rearward insole receiving position between the molds when the upper mold is in its elevated position.

34. The method according to claim 32 wherein the relative closing movement is effected, after the insole is transported between the molding surfaces, by lowering the upper mold to a lower position with its molding surface spaced from the molding surface of the lower mold which is in a lower position; thereafter raising the lower mold a relatively great distance under relatively light pressure, said relatively great distance being an amount sufficient to press the insole between the complementary molding surfaces and thus commence to mold the insole; and thereafter imparting relatively high upwardly directed pressure to the lower mold while raising the lower mold a relatively short distance to complete the molding of the insole.

35. The method according to claim 33 further comprising: providing at least one applicator located above the last when the last support is in its forward position; providing a segment of adhesive that is located on the applicator and is so constituted as to be separated from the applicator and adhere to an object when the applicator is pressed against the object; so reciprocating the applicator, when the last support is in its initial forward position, as to cause the applicator to move downwardly and press the adhesive segment against the last bottom and then move upwardly of the last, the pressing of the adhesive segment against the last bottom causing the adhesive segment to adhere to the last bottom; and moving the last support forwardly back to its forward position after the molded insole has descended onto the last bottom; and wherein the molded insole is attached to the last bottom by reciprocating the applicator so as to cause the applicator to move downwardly and press the insole against the last bottom to thereby enable the insole to adhere to the last bottom by way of the adhesive segment and then move upwardly of the insole.

36. The method according to claim 35 further comprising: presenting a new segment of adhesive to the applicator after the applicator has moved upwardly of the insole pursuant to the second mentioned reciprocation of the applicator.

37. The method according to claim 35 wherein the tape segment is a part of a tape strip extending about the applicator, the strip having adhesive coated on its downwardly facing side that is so constituted as to be separated from the strip when the coated side of the strip is pressed against an object.

38. The method according to claim 37 further comprising: so feeding the tape strip past the applicator as to provide a new segment of the strip extending about the applicator after the applicator has moved upwardly of the insole pursuant to the second mentioned reciprocation of the applicator.

39. A method of molding an insole comprises: providing a lower mold and an upper mold that is located above the lower mold, the molds having complementary molding surfaces on the top surface of the lower mold and the bottom surface of the upper mold; initially so locating the molds that the molding surfaces are spaced from each other with a flat insole located between the molding surfaces; thereafter raising the lower mold a relatively great distance under relatively light pressure, said relatively great distance being an amount sufficient to press the insole between the complementary molding surfaces and thus commence to mold the insole; and thereafter imparting relatively high upwardly directed pressure to the lower mold while raising the lower mold a relatively short distance to complete the molding of the insole.

40. A method of attaching a molded insole to a last bottom comprising: supporting a last bottom-up; providing at least one applicator located above the last; providing a segment of adhesive that is located on the applicator and is so constituted as to be separated from the applicator and adhere to an object when the applicator is pressed against the object; reciprocating the applicator so as to cause the applicator to move downwardly and press the adhesive segment against the last bottom and then move upwardly of the last, the pressing of the adhesive segment against the last bottom causing the adhesive segment to adhere to the last bottom; thereafter enabling a molded insole to be placed on the last bottom; and thereafter reciprocating the applicator so as to cause the applicator to move downwardly and press the insole against the last bottom to thereby enable the insole to adhere to the last bottom by way of the adhesive segment and then move upwardly of the insole.

41. The method according to claim 40 further comprising: presenting a new segment of adhesive to the applicator after the applicator has moved upwardly of the insole pursuant to the second mentioned reciprocation of the applicator.

42. The method according to claim 40 wherein the tape segment is a part of a tape strip extending about the applicator, the strip having adhesive coated on its downwardly facing side that is so constituted as to be separated from the strip when the coated side of the strip is pressed against an object.

43. The method according to claim 42 further comprising: so feeding the tape strip past the applicator as to provide a new segment of the strip extending about the applicator after the applicator has moved upwardly of the insole pursuant to the second mentioned reciprocation of the applicator.

44. A machine for molding an insole comprising: a lower mold; an upper mold located above the lower mold; complementary molding surfaces on the top surface of the lower mold and the bottom surface of the upper mold; means for initially maintaining the molding surfaces spaced from each other while a flat insole is transported between the molding surfaces; means for thereafter effecting relative closing movement between the molding surfaces to mold the flat insole to the shape of the molding surfaces; means for thereafter imparting relative opening movement of the molding surfaces; and a lifting mechanism operative to lift at least part of the molded insole upwardly of the lower mold molding surface when pressure is removed from the lower mold molding surface pursuant to said relative opening movement of the molding surfaces.

45. The machine according to claim 44 wherein the lifting mechanism comprises: at least one pin in the lower mold so mounted as to be yieldably urged upwardly of the lower mold molding surface and to be depressible into the lower mold pursuant to the application of pressure against the pin.

* * * * *